US008307906B2

(12) United States Patent
Reilly et al.

(10) Patent No.: US 8,307,906 B2
(45) Date of Patent: Nov. 13, 2012

(54) APPARATUS AND METHOD FOR AUTOMATIC CONVERSION OF SPRINKLER SYSTEM

(75) Inventors: William J. Reilly, Langhorne, PA (US); Kevin J. Blease, Easton, PA (US); Matthew J. Puzio, Easton, PA (US)

(73) Assignee: Victaulic Company, Easton, PA (US)

( * ) Notice: Subject to any disclaimer, the term of this patent is extended or adjusted under 35 U.S.C. 154(b) by 453 days.

(21) Appl. No.: 12/364,976

(22) Filed: Feb. 3, 2009

(65) Prior Publication Data

US 2010/0193202 A1 Aug. 5, 2010

(51) Int. Cl.
*A62C 35/00* (2006.01)
*A62C 37/36* (2006.01)
*A62C 35/60* (2006.01)

(52) U.S. Cl. ..... 169/20; 169/9; 169/16; 169/17; 169/19; 169/23

(58) Field of Classification Search ..... 169/9, 14, 169/15, 16, 17, 18, 19, 20, 22, 23, 42, 43, 169/46
See application file for complete search history.

(56) References Cited

U.S. PATENT DOCUMENTS

| | | | | |
|---|---|---|---|---|
| 3,958,643 | A | 5/1976 | Landsberg | |
| 5,720,351 | A * | 2/1998 | Beukema et al. | 169/61 |
| 6,209,654 | B1 * | 4/2001 | Curless | 169/17 |
| 6,293,348 | B1 | 9/2001 | Reilly | |
| 6,378,616 | B2 | 4/2002 | Reilly | |
| 6,536,533 | B2 | 3/2003 | Reilly | |
| 6,666,277 | B2 | 12/2003 | Reilly | |
| 6,708,771 | B2 * | 3/2004 | Reilly | 169/16 |
| 6,752,217 | B2 | 6/2004 | Reilly | |
| 7,185,711 | B2 | 3/2007 | Jackson et al. | |
| 7,240,740 | B2 | 7/2007 | Reilly et al. | |
| 2004/0020663 | A1 * | 2/2004 | Jackson et al. | 169/20 |
| 2007/0000671 | A1 | 1/2007 | Reilly et al. | |
| 2009/0288846 | A1 * | 11/2009 | Leblanc | 169/17 |

OTHER PUBLICATIONS

UK International Search Report regarding International Application No. GB1001731.7.

* cited by examiner

*Primary Examiner* — Len Tran
*Assistant Examiner* — Ryan Reis
(74) *Attorney, Agent, or Firm* — Ballard Spahr LLP

(57) ABSTRACT

Apparatus and method for converting a fire suppression system from a single interlock electric or double interlock electro-pneumatic system to a single interlock pneumatic system which draws no electrical power. A pneumatic actuator is in fluid communication with a pressurized piping network and a control valve controlling flow of fire suppressant to the network. The pneumatic actuator is isolated from the piping network by a check valve and a latching solenoid valve. In the event of a power failure the latching solenoid valve is opened, placing the pneumatic actuator in fluid communication with the piping network. Electrical power is drawn only to change the state of the latching solenoid valve, it otherwise draws no power. When the latching solenoid valve is open the pneumatic actuator controls actuation of the control valve, and triggers the control valve when there is a pressure change in the piping network indicative of a fire.

19 Claims, 13 Drawing Sheets

10
12
14
16
18
20
22
24
26
28
30
32
34
36
38
40
42
44
46
48
50
52
54
56
58
146
TO DRAIN

TO DRAIN
12
14
16
18
20
22
24
28
30
32
34
36
38
40
42
44
46
48
50
52
54
56
58
60
62
64
146

14
22b
156
152
176
178
168
162
172
166
160
146
180
164
170
182
158
174
154
86
18
18

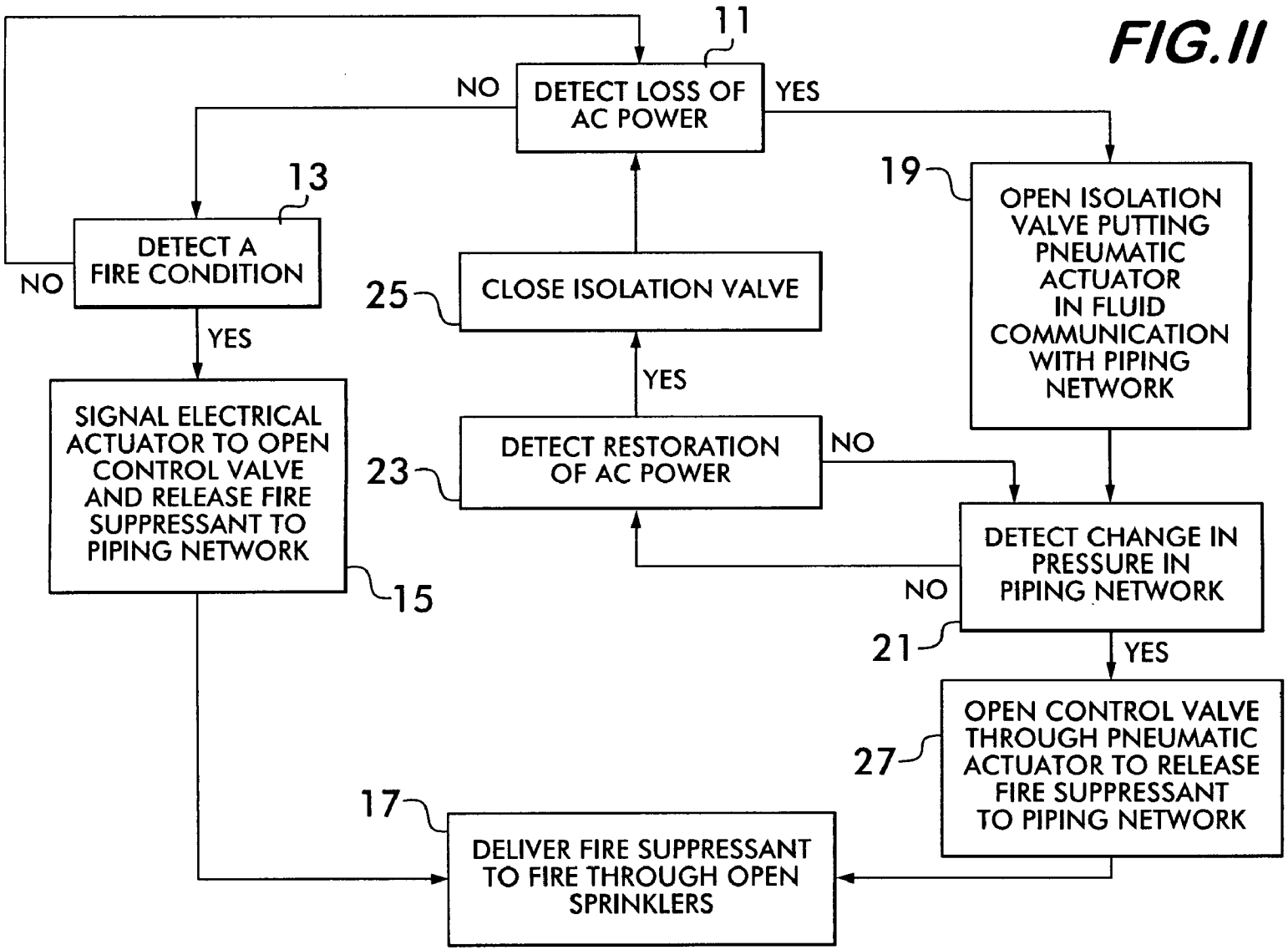
FIG. 11
DETECT LOSS OF AC POWER
11
YES
NO
OPEN ISOLATION VALVE PUTTING PNEUMATIC ACTUATOR IN FLUID COMMUNICATION WITH PIPING NETWORK
19
CLOSE ISOLATION VALVE
25
YES
DETECT RESTORATION OF AC POWER
23
NO
DETECT CHANGE IN PRESSURE IN PIPING NETWORK
21
YES
NO
OPEN CONTROL VALVE THROUGH PNEUMATIC ACTUATOR TO RELEASE FIRE SUPPRESSANT TO PIPING NETWORK
27
DELIVER FIRE SUPPRESSANT TO FIRE THROUGH OPEN SPRINKLERS
17
DETECT A FIRE CONDITION
13
YES
NO
SIGNAL ELECTRICAL ACTUATOR TO OPEN CONTROL VALVE AND RELEASE FIRE SUPPRESSANT TO PIPING NETWORK
15

APPARATUS AND METHOD FOR AUTOMATIC CONVERSION OF SPRINKLER SYSTEM

FIELD OF THE INVENTION

This invention relates to fire suppression sprinkler systems, and especially to dry pre-action systems which are convertible from electrical to pneumatic operation and vice-versa.

BACKGROUND

Of the various types of fire suppression systems, the dry pre-action system finds widespread use, especially in facilities where it is important to avoid accidental or inadvertent activation. Typical applications for dry pre-action systems include museums, libraries and computer centers, where water damage to property is a serious consideration. Such systems are also suitable for residential use as applied by NFPA 13, 13R and 13D including applications to concealed space as well as attic applications.

Dry pre-action systems comprise a piping network that extends throughout the building or other structure to be protected. The network is in fluid communication with a source of pressurized fire suppressant, typically water from a service main. Sprinklers in fluid communication with the piping network are distributed along the network. The sprinklers are normally closed, but open to discharge the water in response to heat from a fire, often through the use of a fusible link, such as a heat sensitive glass bulb or a mechanism held together by a solder having a predetermined melting point.

The system is known as "dry" because water is not normally present in the piping network. Water flow to the network is controlled by a control valve which is opened in response to a fire condition. There are two dominant methods used to open the control valve, the single interlock and double interlock systems. In the single interlock system, a single event, such as the activation of a fire detection sensor (for example, a smoke detector, heat detector, flame detector, temperature sensor or other type of sensors) or the opening of a sprinkler, triggers the opening of the control valve providing water to the system. In the double interlock system, two events indicative of a fire, such as the activation of a fire detection sensor and the opening of a sprinkler must occur contemporaneously to trigger opening of the control valve.

Dry pre-action fire suppression systems, both single interlock and double interlock type, often rely on AC power for operation of various electrical and electronic components comprising the system. For example, the system may have a microprocessor based electronic control system, relays, solenoid valves and electrically powered sensors. If AC power is lost then the system is non-functional and there is no fire protection. To avoid this situation battery back-up power is provided. This is effective as long as the battery power is available. If the AC power outage outlasts the battery life however, the problem of a non-functioning fire suppression system, and an absence of fire protection, remains a serious concern and is unacceptable in many situations.

There is clearly a need for a fire suppression sprinkler system which can be automatically converted, in the event of a power failure, from one which depends on electrical power, to one which is independent of electrical power, either AC or battery back-up.

SUMMARY

The invention concerns a fire suppression sprinkler system for conducting a fire suppressant from a pressurized source of the suppressant to a fire. The system is powered by an electrical power supply and an electrical battery and comprises a piping network in fluid communication with the pressurized source of fire suppressant. At least one sprinkler is in fluid communication with the piping network, the sprinkler being normally closed and having means for opening in response to a fire. A control valve is positioned in the piping network between the pressurized source and the sprinkler for controlling flow of the fire suppressant from the pressurized source to the sprinkler. The control valve is normally maintained in a closed configuration and is openable to permit the fire suppressant to flow to the sprinkler. A source of compressed gas is in fluid communication with the piping network between the control valve and the sprinkler for pressurizing the piping network with the gas. An electrical actuator is associated with the control valve for opening the control valve in response to an electrical signal. The electrical actuator is powered at least by the power supply. A pneumatic actuator is in fluid communication with the piping network. The pneumatic actuator is associated with the control valve for opening the control valve in response to a pressure change within the piping network. An isolation valve is in fluid communication with the pneumatic actuator and the piping network. The isolation valve is powered by the power supply or the battery and settable in either an open configuration, allowing fluid flow between the piping network and the pneumatic actuator, or a closed configuration, preventing fluid flow between the piping network and the pneumatic actuator. The isolation valve draws no electrical power when set in either of the open or closed configurations.

The system according to the invention also includes at least one fire sensor co-located with the sprinkler. The fire sensor is powered at least by the power supply. A control system is in communication with the electrical actuator, the isolation valve, and the fire sensor. The control system is powered by the power supply and the battery and has a circuit to detect loss of power from the power supply. The control system is programmed to set the isolation valve in the open configuration in response to a loss of power from the power supply.

The control system may also include a circuit to detect a resumption of power from the power supply. The control system is further programmed to set the isolation valve in the closed configuration in response to a resumption of power.

The isolation valve comprises, for example, a latching solenoid valve. In one embodiment, the control valve comprises a chamber in fluid communication with the pressurized source of fire suppressant. The control valve is maintained in the closed configuration when the chamber is pressurized, and opened to permit the fire suppressant to flow to the sprinkler by depressurizing the chamber. The electrical actuator comprises a solenoid valve in fluid communication with the chamber. The solenoid valve is normally closed and is openable in response to an electrical signal from the control system. Opening of the solenoid valve depressurizes the chamber and thereby allows the control valve to open.

In one embodiment, the pneumatic actuator comprises a first valve in fluid communication with the chamber. The first valve is normally closed, and opening of the first valve depressurizes the chamber and thereby allows the control valve to open. A second valve is in fluid communication with the first valve and the piping network. The second valve is normally closed and openable in response to a change in gas pressure within the piping network. Opening of the second valve causes the first valve to open.

In another embodiment the system further comprises a second pneumatic actuator in fluid communication with the piping network. The second pneumatic actuator is associated with the control valve for opening the control valve in response to a pressure change within the piping network. The second pneumatic actuator cooperates with the electrical actuator to open the control valve. The control valve is openable in response to the electrical signal to the electrical actuator and the pressure change within the piping network.

The invention also encompasses a method of operating a fire suppression sprinkler system. As noted above, the system includes a piping network in fluid communication with a source of pressurized fire suppressant, the method comprising:

(a) detecting a loss of AC power to the system;

(b) detecting a change in pressure within the piping network indicative of a fire;

(c) releasing the fire suppressant to the piping network in response to the change in pressure;

(d) delivering the fire suppressant to the fire through the piping network; otherwise:

(e) not detecting a loss of AC power to the system;

(f) detecting a fire;

(g) using an electric signal to trigger a release of the fire suppressant to the piping network;

(h) delivering the fire suppressant to the fire through the piping network.

In an alternate embodiment, the method also includes detecting restoration of AC power to the system.

BRIEF DESCRIPTION OF THE DRAWINGS

FIG. 11 is a flow chart illustrating a method of operating a fire suppression system according to the invention;

DETAILED DESCRIPTION

Figure 1:
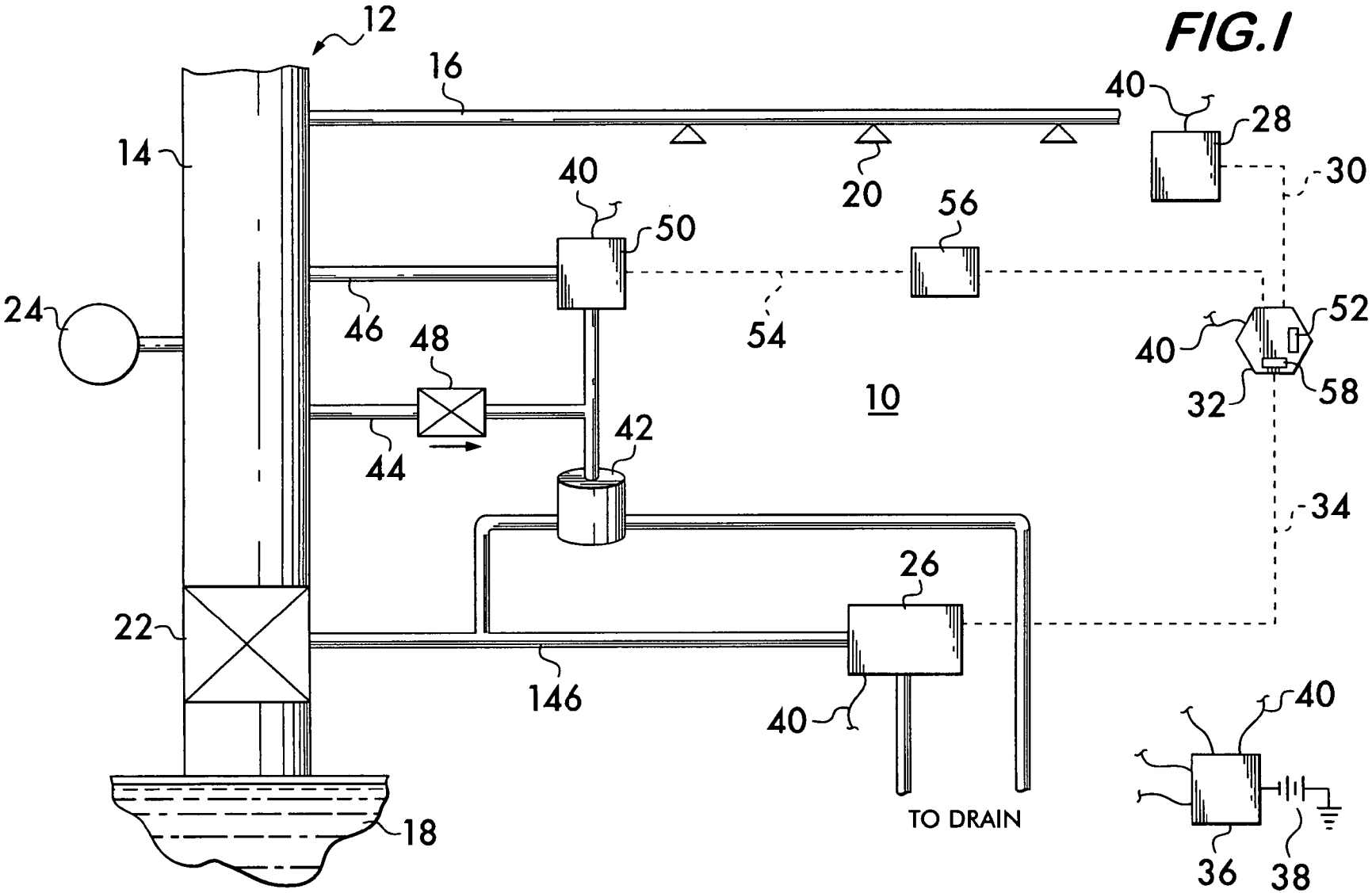
FIG. 1 is a schematic view of a single interlock dry pre-action fire suppression system according to the invention.

FIG. 1 shows a schematic diagram of an example fire suppression system 10 according to the invention. System 10 is a single interlock pre-action electrical system and comprises a piping network 12 including risers 14 and branch lines 16 in fluid communication with the risers. Only one riser and branch are shown, it being understood that these are representational of a system which will have a plurality of risers and branches. Riser 14 is in fluid communication with a pressurized source of fire suppressant 18, in this example, water from a service main. Other fire suppressants usable with the invention include gaseous suppressants. Branch lines 16 extend throughout the structure or building in which the system is located, there being one or more sprinklers 20 in fluid communication with the branch lines for discharging water to suppress a fire. The sprinklers 20 are normally closed and have well known means for opening in response to a fire. In one example, a frangible glass bulb, filled with a temperature sensitive liquid, breaks to allow the sprinkler to open when a predetermined temperature is reached in the vicinity of the sprinkler. In another example, the opening means comprises a trigger mechanism held together by a solder which melts at a predetermined temperature. When the solder melts in response to the heat of a fire the mechanism opens and allows the sprinkler to discharge the fire suppressant onto the fire.

A control valve 22 is positioned in the riser 14 between the pressurized source 18 and the sprinklers 20 and controls the flow of suppressant to the network. In this dry system 10 the control valve 22 is maintained closed in the absence of a fire condition and the piping network downstream of the control valve is pressurized with a gas, usually air or nitrogen, for example, from a source of compressed gas 24, which could be, for example, a compressor or a compressed gas bottle or reservoir. An electrical actuator 26 is operatively associated with the control valve 22 and is used to open the valve in the event of a fire. (The detailed arrangement of an example control valve and electrical actuator are described below.) One or more fire sensors 28, located in the vicinity of sprinklers 20, are used to detect a fire condition. Fire sensors 28 may be, for example, smoke detectors, temperature sensors, infrared or other light detectors which are used to sense a fire condition and generate an electrical signal indicative thereof. Such signals are transmitted over communication links 30 to a control system 32. Control system 32 is typically a microprocessor based device having resident software, such as approved fire release circuits as supplied by Notifier of Northford, Conn., Potter Electric Signal Company LLC, of St. Louis, Mo., and others. Control system 32 is also in communication with electrical actuator 26 over a communication link 34. The communication links could be for example, coaxial cable, or wireless links between the components. The various electrical devices including the electrical actuator 26, the control system 32 and the sensors 28 are powered by an electrical power supply 36 with a battery back-up 38. Power cables 40 extend from the power supply to the various components, the cables 40 not being shown in their entirety for clarity. Power supply 36 is typically the AC power provided to the building or other structure in which the fire suppression system 10 is located. The power supply is thus subject to outages, and therefore the battery back-up 38 is provided.

Under normal operational conditions, when AC power is available, if a fire breaks out, one or more sensors 28 detect the fire and send a signal to the control system 32 which sends a signal to the electrical actuator 26, ordering it to open control valve 22 and supply fire suppressant from the source 18 to the piping network 12. Sprinklers 20 in the vicinity of the fire open in response to the heat and discharge the fire suppressant onto the fire. If AC power is interrupted, for example during a power outage, the system will operate as described using the battery back-up 38. However, if the outage outlasts the battery life there will be a time period wherein the system will not be powered and no fire protection will be available. To avoid this situation a pneumatic actuator 42 is provided. The pneumatic actuator 42 is operatively associated with the control valve 22 and is in parallel fluid communication with the piping network 12 through two conduits 44 and 46. Fluid flow through conduit 44 is through a check valve 48 which permits gas to flow to the pneumatic actuator 42, but prevents back flow from the check valve. Fluid flow through the conduit 46 is through an isolation valve 50 which is settable in either an open configuration, which allows two way fluid communication between the pneumatic actuator 42 and the piping network 12, or a closed configuration, which, in cooperation with the check valve 48, prevents any back flow to the piping network 12, effectively isolating the pneumatic actuator 42 and preventing its operation as described below.

Although the isolation valve 50 is electrically actuated by the power supply 36 and the control system 32, the isolation valve draws no power when in either the closed or open configurations. An example of such a valve is a latching solenoid valve. Latching solenoids operate similarly to a standard solenoid, but instead of a spring returning the plunger to its normal condition when current is removed from the coil, permanent magnets hold the plunger in a desired position, thus maintaining the isolation valve 50 in either the closed or open position without drawing any power. A pulse of electrical current is applied to the coil to change the position of the plunger and thereby open or close the valve actuated by the latching solenoid. The pulse through the coil generates enough force to move the plunger through the field of one permanent magnet to its desired position, where a second permanent magnet holds the plunger in its newly desired position. Commercially available latching solenoid valves are supplied by Norgren, Inc. of Littleton, Colo. and ASCO Valve Inc. of Florham Park, N.J.

In addition to latching solenoid valves, other electrically actuated valves are feasible for use as the isolation valve 50. For example, electrically actuated ball valves, globe valves, butterfly and gate valves all have the characteristic that they may be electrically actuated (i.e., opened or closed) but draw no power when in the opened or closed state.

Control system 32 has a circuit 52 which detects a loss of AC power. When AC power loss is detected, the control system, operating on battery back-up, sends a signal, for example a DC pulse, to the isolation valve 50 over a communication line 54 which passes through an interface driver module 56. The driver module performs various logic functions, described below, which open the isolation valve 50, effecting two way fluid communication between the pneumatic actuator 42 and the piping network 12. The DC pulse may be from the battery backup 38, or from another source, such as capacitors which may be part of the power supply 36. With two way fluid communication established, the pneumatic actuator 42 can operate to sense a fire condition and open the control valve 22 whether or not there is any electrical power available. An example pneumatic actuator 42 is disclosed in U.S. Pat. No. 6,293,348, and hereby incorporated by reference. The details of the pneumatic actuator 42 and its operation are described below. In general, the pneumatic actuator operates by sensing a change in the pressure within the piping network, and, in response, relieving pressure in a chamber in the control valve 22 which otherwise operates to hold the control valve closed. The change in pressure within the piping network is usually a pressure drop which occurs as a result of a sprinkler opening, the piping system normally being maintained at a pressure higher than atmospheric by the compressed gas source 24. The pneumatic actuator 42 senses a pressure drop only when gas is permitted to flow from it to the piping network, hence, when this is prevented by the check valve 48 and a closed isolation valve 50 the pneumatic actuator is inoperative, as is the case when AC power is available. The control system also has a circuit 58 which detects the restoration of AC power to the system. When AC is restored, the control system 32 sends signals which close the isolation valve 50 and isolate the pneumatic actuator 42 from the piping network 12. The system 10 then operates as a single interlock system through the electrical actuator 26 and the sensors 28.

Figure 2:
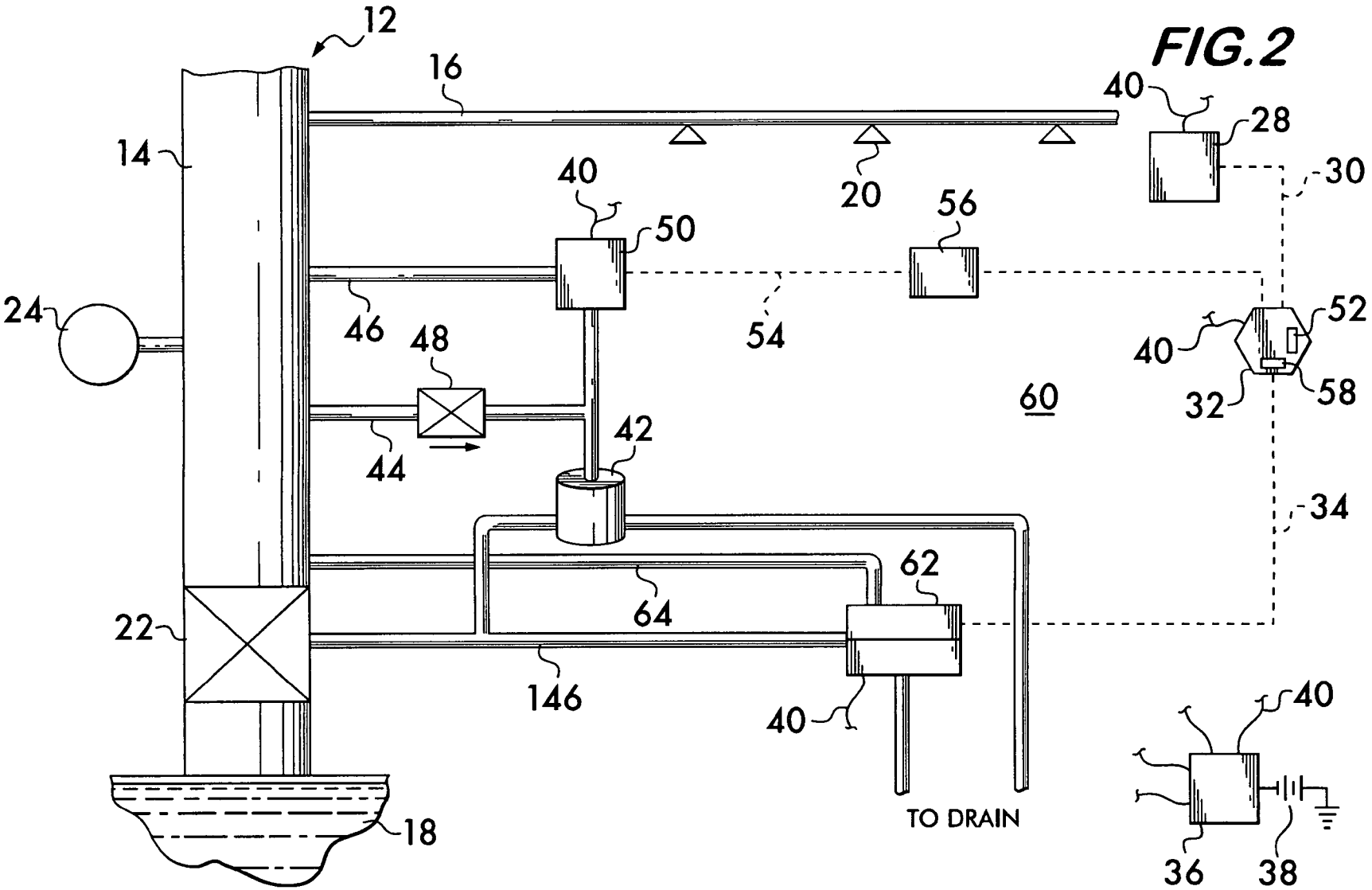
FIG. 2 is a schematic view of a double interlock dry pre-action fire suppression system according to the invention.

FIG. 2 shows another embodiment 60 of a fire suppression sprinkler system according to the invention. System 60 differs from system 10 in that it is a double interlock system which uses an electro-pneumatic actuator 62 in place of the electrical actuator 26 to open control valve 22. An example electro-pneumatic actuator 62 is disclosed in U.S. Pat. No. 6,708,771, hereby incorporated by reference. In this double interlock system two criteria must be met before the control valve 22 is opened to release fire suppressant to the piping network 12. The sensors 28 must detect a fire condition, and there must be a pressure change in the piping network occasioned by a sprinkler opening. The sensors 28 signal the fire condition to the control system 32, which, in turn, signals the electrical part of the electro-pneumatic actuator 62 over communication link 34 to open the control valve 22. The pneumatic part of the electro-pneumatic actuator 62 contemporaneously senses the change in pressure of the piping system 12 through a conduit 64 connecting the electro-pneumatic actuator to the piping network. With both criteria met the electro-pneumatic actuator 62 operates in response to open the control valve 22.

Together the electric and pneumatic parts of the electro-pneumatic actuator 62 function as a logical "AND" gate, requiring that two separate criteria be met before the system is activated. This "AND" function is especially useful in preventing inadvertent system activation, for example, if a sprinkler is damaged and opens in response to the damage, and not in response to the heat of a fire. However, this double interlock system depends upon electrical power for its functioning and therefore the use of the pneumatic actuator 42 and the isolation valve 50 are effective to ensure that the system 60 continues to provide fire protection in the event of a power failure, even when battery back-up is exhausted, in the same way as described for system 10.

Driver Module Operational Logic

Figure 12:
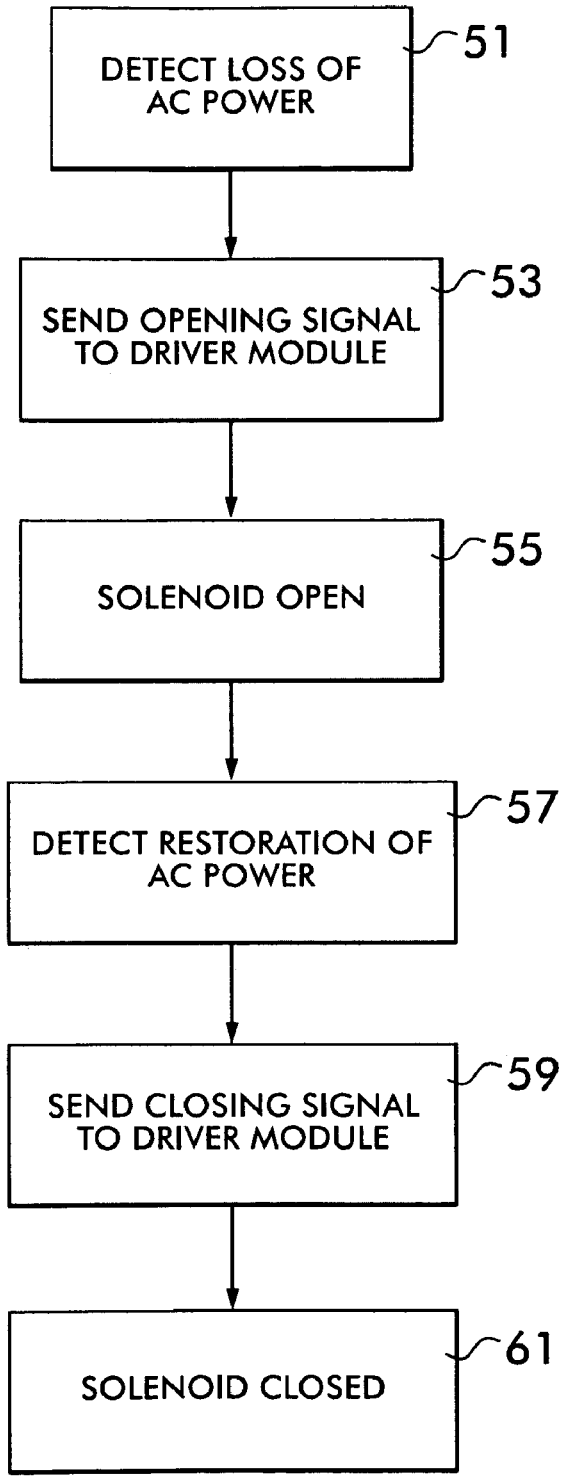
FIG. 12 is a flow chart illustrating the logical operation of a component of the fire suppression system according to the invention.

FIG. 12 is a flow chart which illustrates the logical operation of driver module 56. Upon the detection of loss of AC power (51) by the detection circuit 52 in control system 32 (see also FIG. 1) the control system sends a signal (53), in the form of a DC pulse, to the driver module 56. In turn, driver 56 operates to pass this signal to the latching solenoid 50 via communication link 54. The DC signal pulse from the driver module 56 opens (55) the latching solenoid 50, thereby placing the pneumatic actuator 42 in fluid communication with the piping network 12. The latching solenoid 50 remains open until the detection of restoration of AC power (57). When the restored AC power is detected, the control system 32 sends another signal (59), in the form of a DC pulse, to the driver module 56 which passes the signal to the latching solenoid, causing it to close (61), and thereby isolate the pneumatic actuator from the piping network, returning the system 10 of FIG. 1 to single interlock electrical pre-action operation.

Driver Module Circuitry

Figure 13:
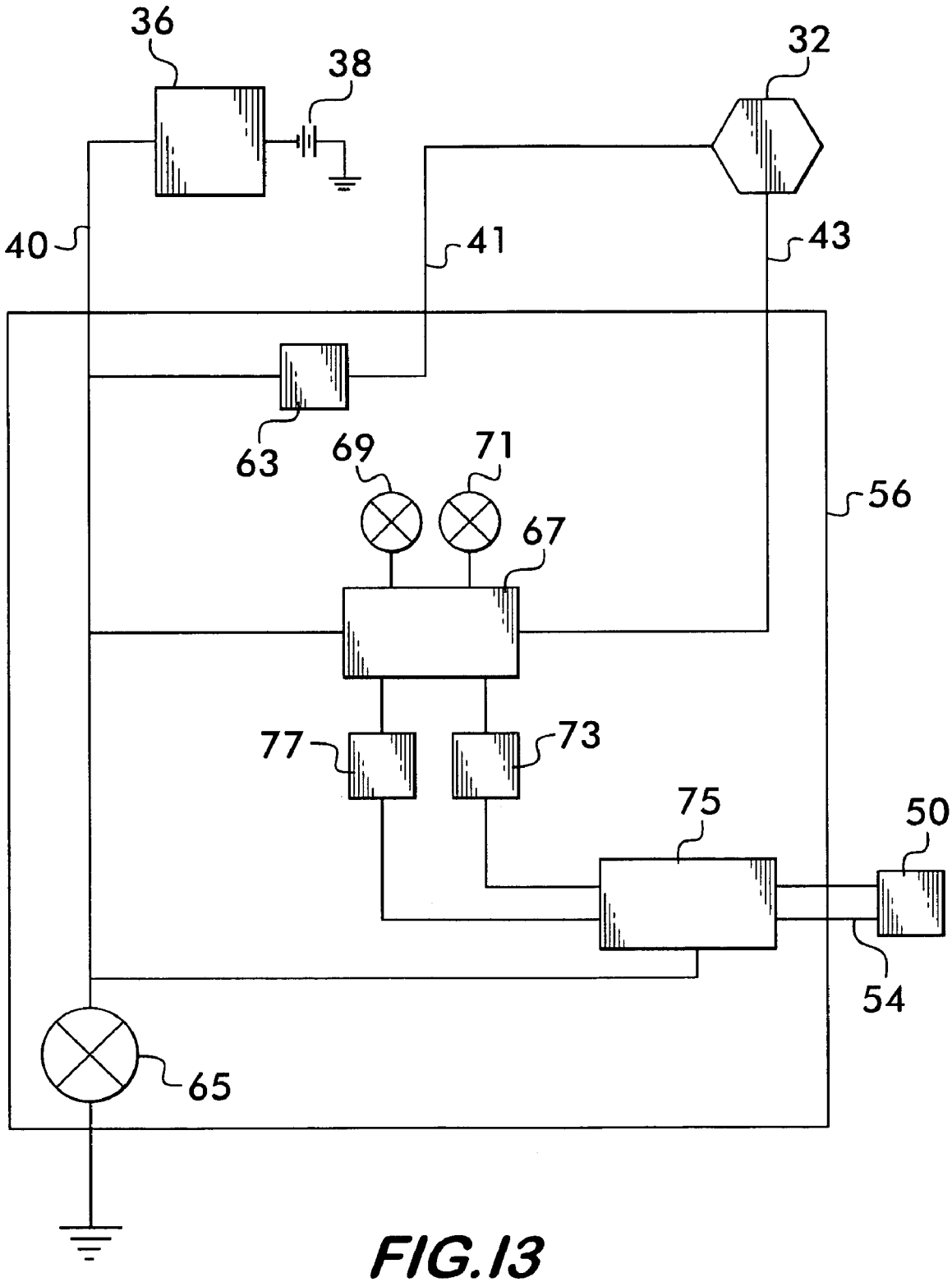
FIG. 13 is a schematic diagram of an example driver module.

FIG. 13 illustrates the circuitry for an example driver module 56. Module 56 has a single pull double throw relay 63 which is used to supervise the DC power supply 36, 38 provided by the battery backup and the control system 32 (see FIG. 1). When the DC power is interrupted, for example by damage to the electrical connections between the control system 32 and the driver module 56, or when the battery is exhausted, there is no power available to change the state of the latching solenoid 50. Relay 63 signals this information to the control system 32 over communication link 41 by toggling between an open and a closed state. The relay 63 is energized by the DC power supply into the open state, indicative of the normal ready condition of the DC power. When DC power is lost the relay 63 toggles to its closed state, providing a signal to the control system 32 which alerts the operators that there is no DC power and steps must be taken to restore it. The driver module 56 also has a signal lamp 65 which goes out as a visual indication of DC power loss.

Driver module 56 also has a double pull double throw relay 67 which is used to control the state of another relay (relay 75, see below) and also control signal lamps 69 and 71 on the driver module 56 to provide a visual indication of the state of AC power and the state of the latching solenoid valve 50. When AC power is available, relay 67 lights yellow lamp 69 indicating that AC power is available and the latching solenoid is closed. When the control module 32 detects a loss of AC power it sends a signal over communication line 43 to relay 67 which extinguishes yellow lamp 69 and lights red lamp 71 providing a visual indication of a loss of AC power.

Relay 67 also operates the other relay 75, which opens and closes solenoid valve 50. Relay 67 sends DC power through an RC timing network 73 to relay 75, which is an H-bridge polarity reversing relay. Relay 75, in turn, delivers a DC pulse to the solenoid valve 50, changing its state from closed to open.

When AC power is restored, it is detected in the control system 32 which sends a signal to relay 67. Relay 67 sends DC power through an RC timer network 77 to the H-bridge relay 75 which sends a DC pulse of reversed polarity to the latching solenoid valve 50, closing the valve.

An example of a practical driver module 56 operates on 24 volts DC, and the RC timer networks 73 and 77 provide a 1 second pulse to the H-bridge relay 75.

Control Valve Description and Operation

Figure 3:
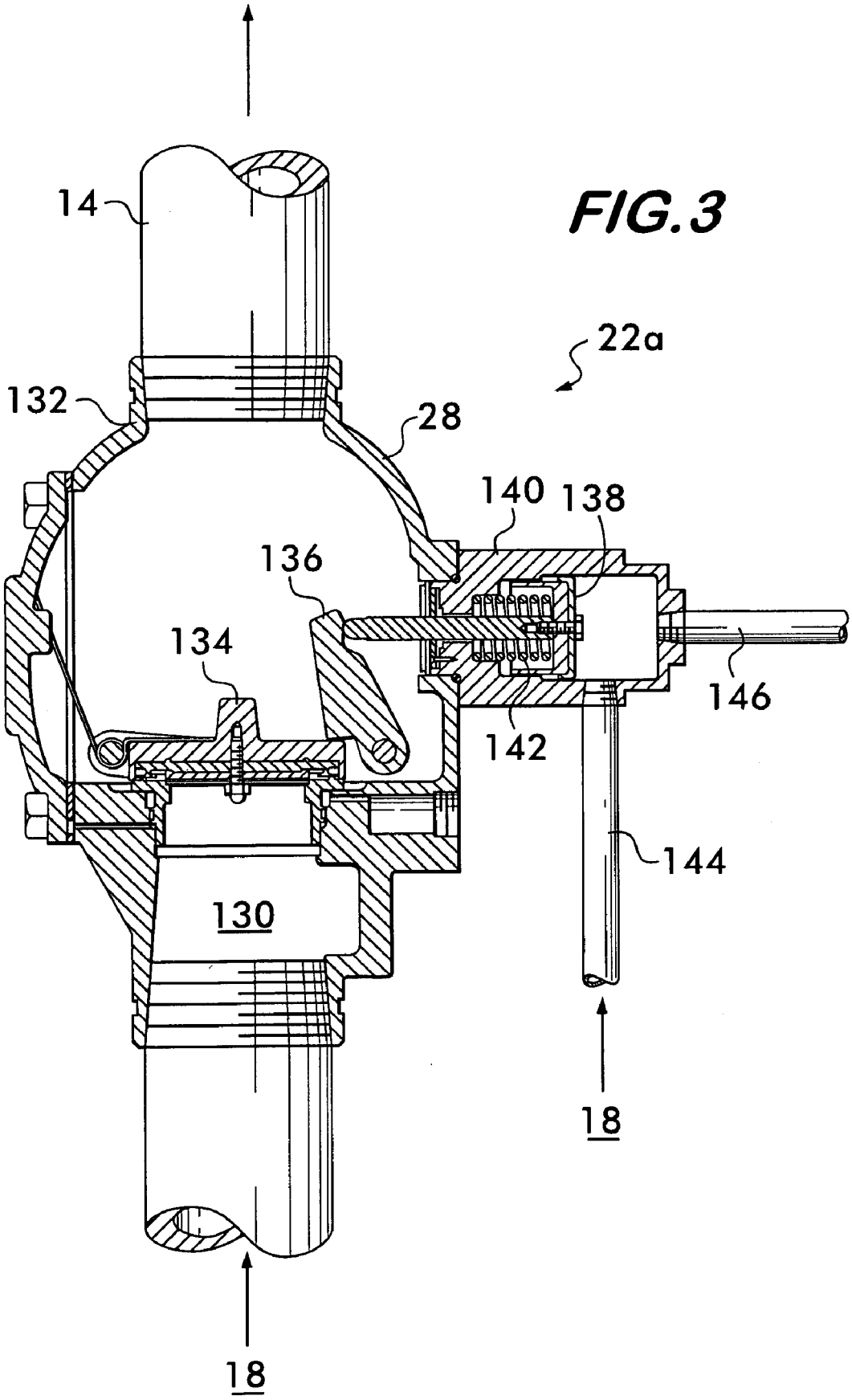
FIG. 3 is a sectional view of an example control valve used with the fire suppression system according to the invention.

FIG. 3 shows an embodiment 22*a* of an example control valve 22 used with fire suppression sprinkler systems according to the invention. Valve 22*a* has an inlet 130 connected to the pressurized source of fire suppressant 18 and an outlet 132 connected to the riser 14 of piping network 12. A clapper 134 is pivotally mounted within the valve 22*a*. Pivoting motion of the clapper opens and closes the inlet controlling the flow of fire suppressant to the system. When the inlet 130 is pressurized, the clapper 134 will open in response to the pressure and, therefore, must be held closed by a latch 136 pivotally mounted within the valve. Latch 136 is held in engagement with the clapper 134 by a piston 138 reciprocably movable within a cylinder or chamber 140. Piston 138 is preferably biased by a spring 142 to move away from and release latch 136, but the piston is held engaged with the latch by water pressure provided by a conduit 144 connecting the inlet 130 to the cylinder 140. A conduit 146 connects the cylinder 140 to the electrical actuator 26 in the single interlock system 10 shown in FIG. 1, or to the electro-pneumatic actuator 62 in the double interlock system 60 shown in FIG. 2.

Figure 4:
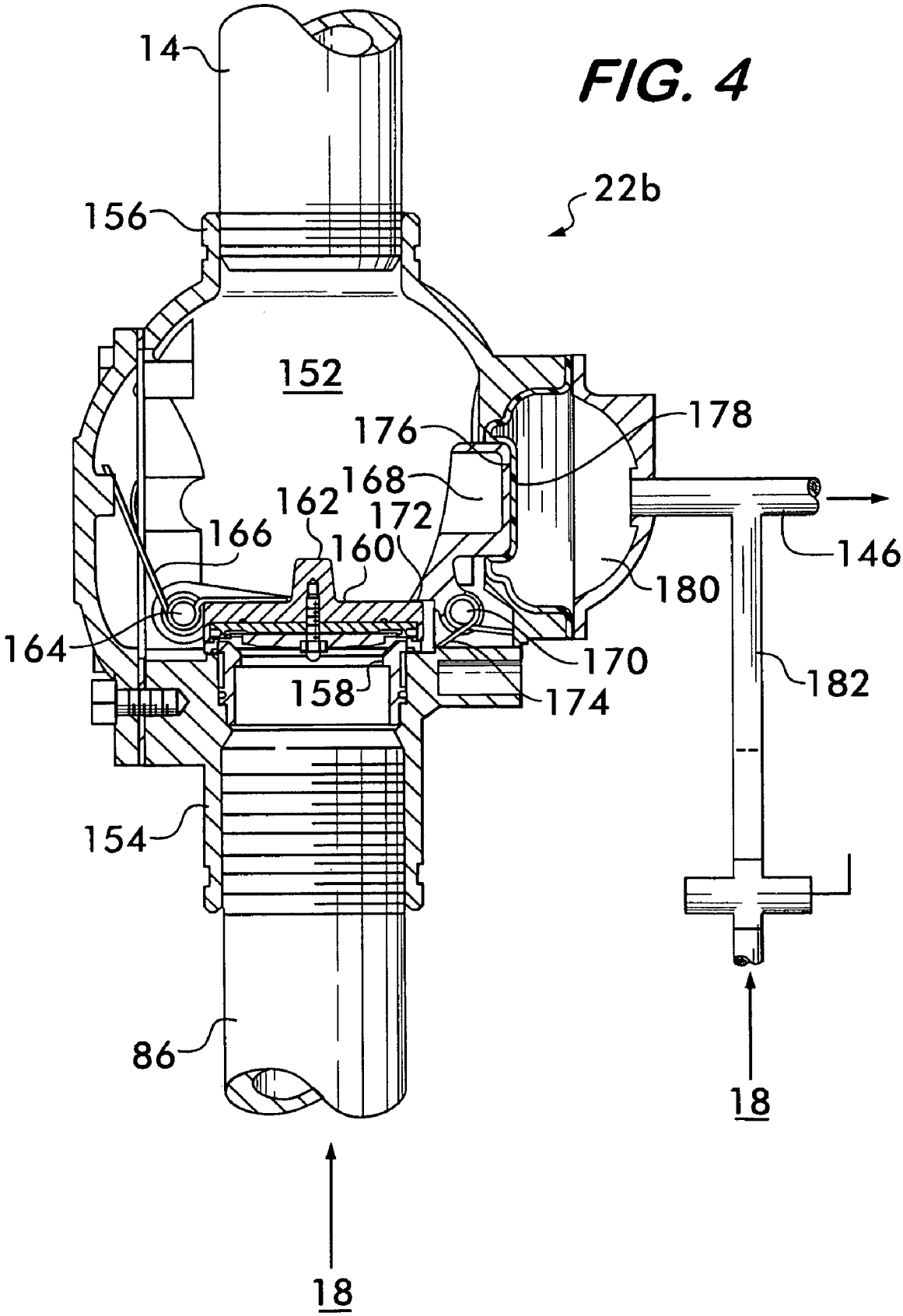
FIG. 4 is a sectional view of another example control valve used with the fire suppression system according to the invention.

FIG. 4 shows another embodiment 22*b* of a control valve 22 used with the fire suppression systems 10 and 60 according to the invention. Valve 22*b* comprises a chamber 152 having an inlet 154 connectable to the source of pressurized fire suppressant 18, and an outlet 156 connected to the riser 14 of piping network 12. A seat 158 surrounds the inlet 154. A valve closure member 160 is movably positioned within the chamber 152. Preferably, the valve closure member comprises a clapper 162 that is pivotably mounted for rotation about an axis 164. Clapper 162 is pivotable between a closed position, shown in FIG. 4, where it engages seat 158 and blocks inlet 154, and an open position, pivoted away from the seat and the inlet.

Clapper 162 is preferably biased into the closed position by a spring 166, the spring being sufficiently stiff so as to pivot the clapper into engagement with the seat 158 in the absence of water pressure within the inlet, the spring otherwise allowing the clapper to open in response to water pressure within the inlet. The spring biasing of clapper 162 is advantageous for resetting the valve.

A latch 168 is also movably positioned within the chamber 152. Latch 168 is preferably pivotable about an axis 170 and has a shoulder 172 engageable with the clapper 162. Latch 168 is movable between a latched position, shown in FIG. 3, where shoulder 172 engages clapper 162, and an unlatched position, where the latch is pivoted away from and out of engagement with the clapper. Preferably, latch 168 is biased into the unlatched position by a biasing spring 174 as explained below.

Latch 168 has a face 176 that engages a flexible diaphragm 178. Diaphragm 178 is preferably formed of fabric reinforced rubber. The diaphragm preferably forms a fluid tight interface between chamber 152 and a second, smaller chamber 180. The second chamber 180 allows the diaphragm to be conveniently pressurized and de-pressurized. This pressurization and depressurization deforms the diaphragm which pivots the latch between the latched and unlatched positions to either maintain the clapper in the closed position or release it so that it may pivot into the open position. Chamber 180 is pressurized by fire suppressant from the pressurized source 18 through a conduit 182 connecting the source to the chamber. The chamber 180 is also in fluid communication with the electrical actuator 26 in the single interlock system 10 shown in FIG. 1, or with the electro-pneumatic actuator 62 in the double interlock system 60 shown in FIG. 2. Communication between the chamber 180 and the electrical actuator 26 or the electro-pneumatic actuator 62 is through conduit 146.

For the single interlock electrical system 10 shown in FIG. 1, under normal operating conditions (i.e., AC power available), in the event of a fire, sensor 28 sends a signal to the control system 32 which sends a signal to the electrical actuator 26, which, in this example, is a solenoid valve. The solenoid valve 26 opens. When control valve 22*a* is used (FIG. 3), opening of the solenoid valve 26 allows fire suppressant to flow through conduit 146 from the cylinder 140 to a drain and thereby releases the pressure within cylinder 140, allowing the piston 138 to move under the biasing force of spring 142 and release latch 136. This allows clapper 134 to open and provide fire suppressant to the piping network 12. When control valve 22*b* is used (FIG. 4), opening of the solenoid valve 26 allows fire suppressant to flow through conduit 146 from the chamber 180 to a drain and thereby releases the pressure within chamber 180, allowing the diaphragm 178 to deform and the latch 168 to pivot out of engagement with the clapper 162. This allows clapper 162 to open and provide fire suppressant to the piping network 12.

For the double interlock electrical system 60 shown in FIG. 2, under normal operating conditions (i.e., AC power available), in the event of a fire, sensor 28 sends a signal to the control system 32 which sends a signal to the electro-pneumatic actuator 62. Contemporaneously, one or more of the sprinklers 20 open, causing a drop in the gas pressure within the piping network 12. This is communicated to the electro-pneumatic actuator 62 through conduit 64. The electro-pneumatic actuator, having both the signals required by its "AND" function, operates to open control valve 22. When control valve embodiment 22*a* is used (FIG. 3), the electro-pneumatic actuator 62 operates to allow fire suppressant to flow through conduit 146 from the cylinder 140 to a drain and thereby release the pressure within cylinder 140, allowing the piston 138 to move under the biasing force of spring 142 and release latch 136. This allows clapper 134 to open and provide fire suppressant to the piping network 12. When control valve 22*b* is used (FIG. 4), the electro-pneumatic actuator operates to allow fire suppressant to flow through conduit 146 from the chamber 180 to a drain and thereby release the pressure within chamber 180, allowing the diaphragm 178 to deform and the latch 168 to pivot out of engagement with the clapper 162. This allows clapper 162 to open and provide fire suppressant to the piping network 12.

For both the single interlock system 10 and the double interlock system 60, the conduit 146 is also in fluid communication with the pneumatic actuator 42 as shown in both FIGS. 1 and 2. At the onset of an AC power failure the control system 32 opens the isolation valve 50, thereby placing the pneumatic actuator 42 in fluid communication with the piping network 12 through conduit 46. When the pneumatic actuator 42 senses a pressure drop in the piping network, for example due to a sprinkler opening in response to a fire, it operates as described below to open the control valve 22 and provide fire suppressant to the piping network 12. Opening of the control valve 22 is effected by depressurizing either cylinder 140 or chamber 180, depending on which type of control valve is used, as noted above.

Pneumatic Actuator Description and Operation

Figure 5:
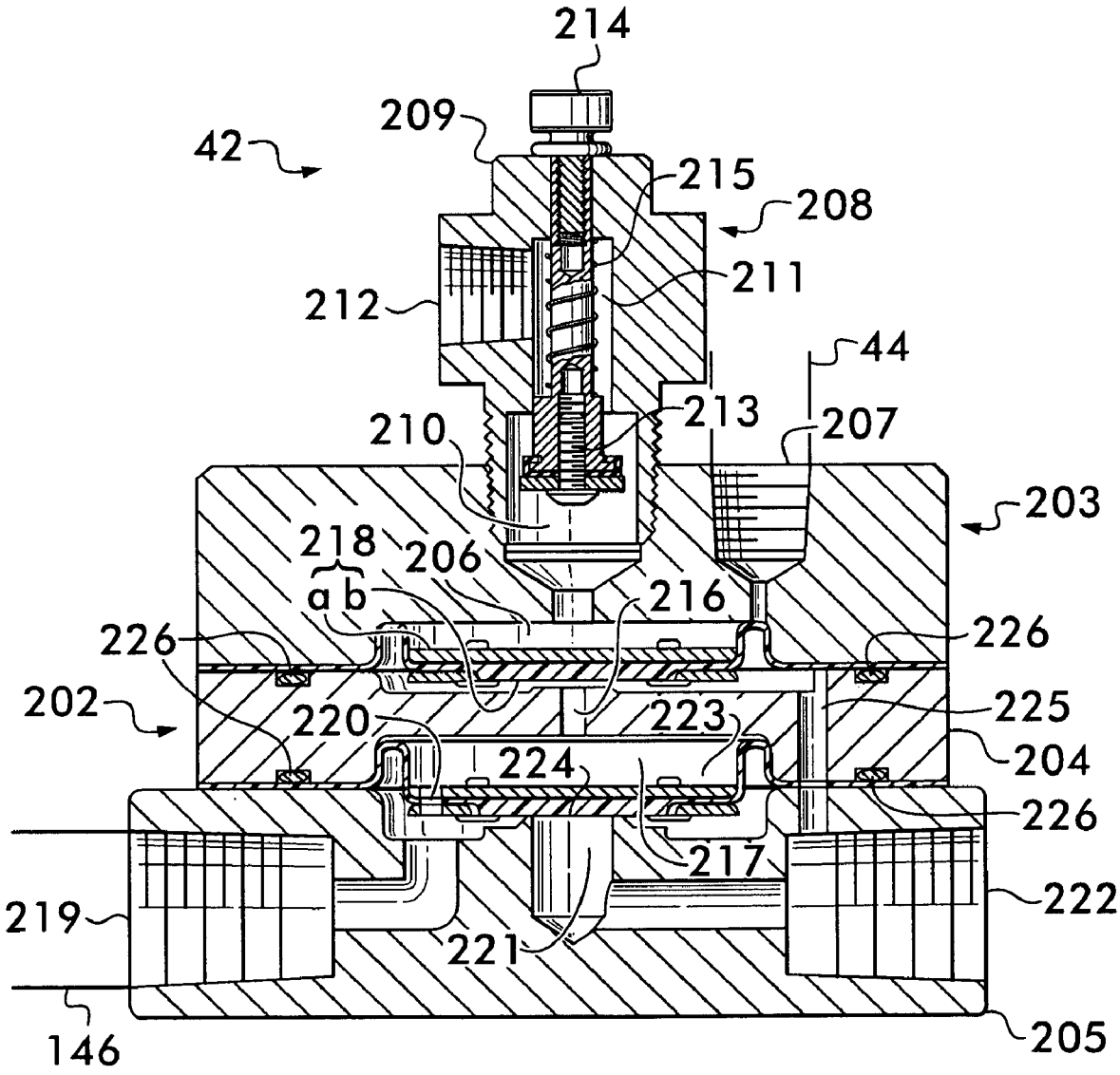
FIGS. 5-8 are sectional views of an example pneumatic actuator used with the fire suppression system according to the invention.

The pneumatic pressure actuator 42, shown in FIG. 5, includes a housing 202, which has a vertical axis, and itself includes three chambers, namely, an upper chamber 203, a middle chamber 204, and a lower chamber 205, spaced along the vertical axis. The housing is constructed of a high strength metallic material, such as brass. However, it should be understood that other materials and processes of manufacture can be used. For instance the housing 202 could be constructed of machined stainless steel or suitably molded plastic or other materials having the requisite strength.

The upper and middle chambers are in communication with each other, as are the middle and lower chambers. The communication between the adjacent chambers can be made fluid-tight by the provision of at least one O-ring at the juncture of respective side ends of each adjacent pair of chambers.

Figure 9:
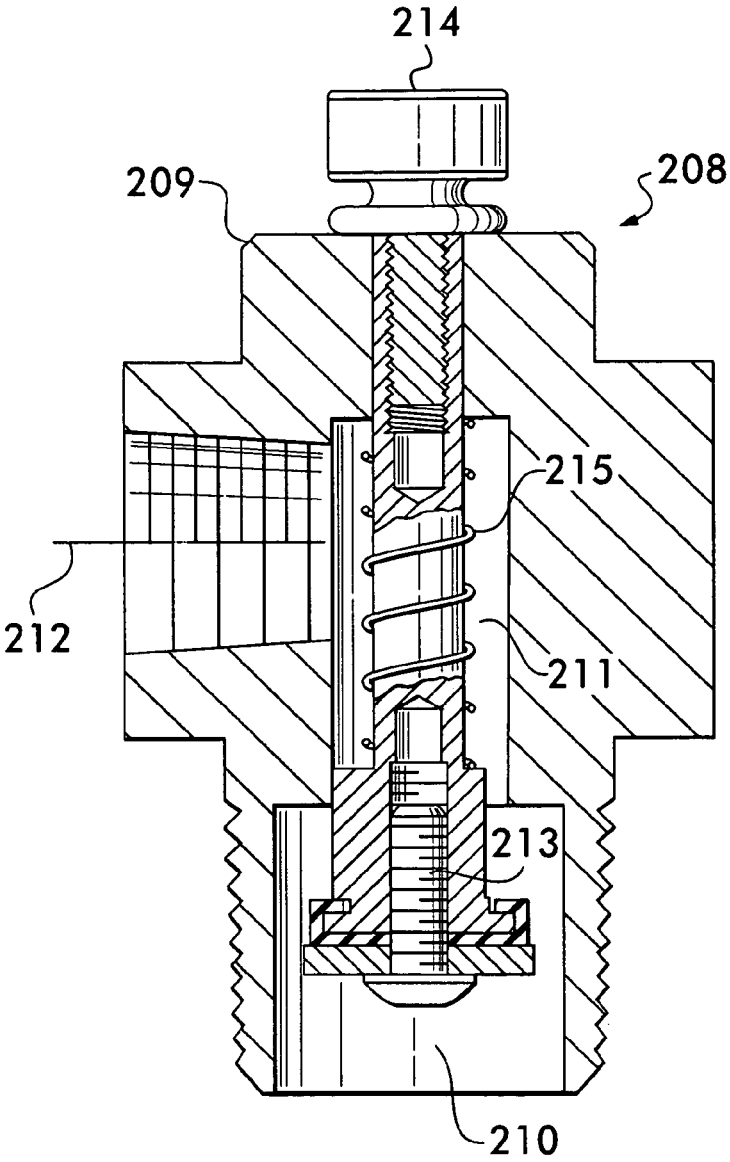
FIG. 9 is a sectional view of a component of the pneumatic actuator shown in FIGS. 5-8.

Referring to FIG. 9, a tripping device 208 is used to establish and regulate air pressure in the pneumatic actuator 42. The tripping device 208 is in communication with the upper chamber 203, and includes a tripping device housing 209 containing a tripping device gas compartment 210, which is in fluid communication with the gas compartment 206 of the upper chamber 203. The tripping device housing 209 further has a gas passageway 211 extending therethrough, leading from the tripping device gas compartment 210 to the tripping device gas outlet orifice 212. A tripping device gas piston 213, is positioned in the tripping device gas passageway 211. The gas piston 213 is alternatively slidable between a closed position, wherein a gas-pressurized condition is established in the tripping device gas compartment 210 and the interior gas compartment 206 of the upper chamber 203, with the gas piston 213 forming a fluid-tight seal between the tripping device gas compartment 210 and the tripping device gas outlet orifice 212; and an open position, wherein gas pressure in the gas compartment 206 of the upper chamber 203 and the tripping device gas compartment 210 is relieved and gas is allowed to flow out from the gas compartment 206 and the tripping device gas compartment 210, through the passageway 211, and out through the gas outlet orifice 212. A mechanical compression spring 215 surrounds the gas piston 213, such that when the gas piston 213 is in the closed position, the spring 215 is compressed and exerts a counter-force to a force caused by air pressure in the tripping device gas compartment 210. Tripping device actuation means 214, such as a knob, is provided for alternatively sliding the gas piston 213 between its closed and its open positions.

Referring again to FIG. 5, the tripping device 208 is first actuated by pressurized gas from the piping network 12 entering gas compartment 206 of upper chamber 203 through restricted gas inlet orifice 207 which is connected to the piping network by conduit 44. The tripping device 208 is first actuated, such as by pulling actuation knob 214 outward, thereby compressing tripping device compression spring 215, to establish a pressure condition in upper chamber gas compartment 206. Gas pressure in gas compartment 206 of upper chamber 203 exerts pressure on upper diaphragm 218, sealing pressure release orifice 216. The upper diaphragm 218 has an upper, gas-side surface area 218*a*, facing the gas compartment 206, and a lower, liquid-side surface area 218*b*, facing the liquid side and the pressure release liquid flow orifice 216. The ratio of the area of the upper, gas-side surface 218*a* of the upper diaphragm 218 to the area of the pressure release liquid flow orifice 216 is typically greater than 60 to 1. By such an arrangement, 1 psi of air pressure is capable of sealing against a water pressure in excess of 60 psi.

Figure 6:
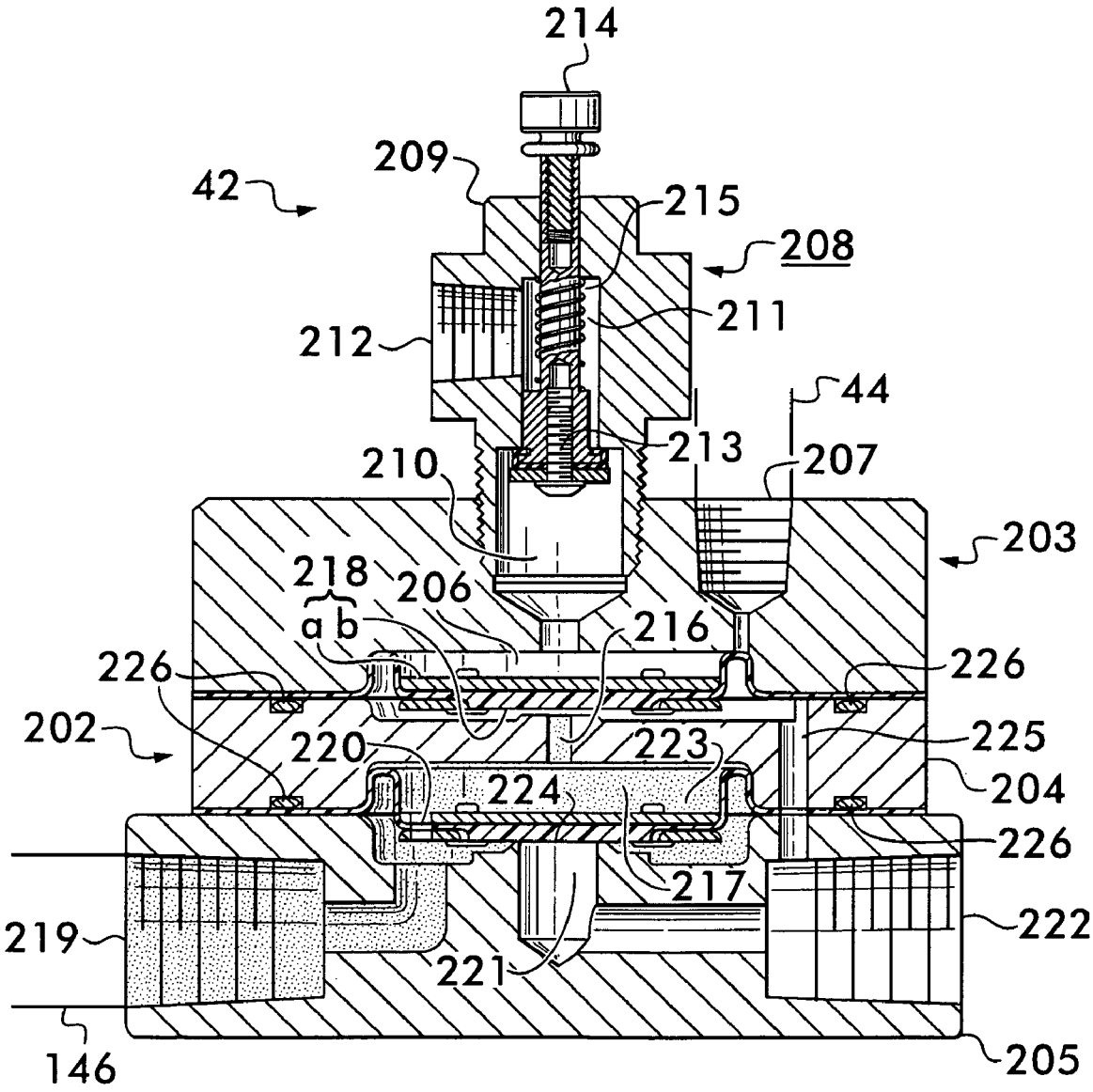

Referring now to FIG. 6, once air pressure is established in the pneumatic actuator 42, on the air side of the upper diaphragm 218*a*, and in the gas compartment 206, the pressurized fire suppressant, in this example, water, is introduced into the pneumatic actuator 42 from the control valve 22 through the conduit 146. The pneumatic actuator 42 has a channel therethrough for water flow. Water from the control valve 22 enters the pneumatic actuator 42 through first liquid inlet orifice 219. From there, it flows through second liquid inlet orifice 220, and into liquid compartment 217 of middle chamber 204. As water fills liquid compartment 217, it pressurizes liquid compartment 217, causing lower diaphragm 223 to seal against a liquid sealing lip 224. Water is retained in the liquid compartment 217 by the air pressure established in gas compartment 206, and the differential area of the lower diaphragm 223 exposed to water. That is, the upper surface of diaphragm 223 has a greater area than the lower surface due to a reduction of the effective area caused by the smaller cross sectional area of first liquid outlet orifice 221. Both the upper diaphragm 218 and the lower diaphragm 223 are fabricated from a flexible material, and are preferably formed of rubber.

Figure 7:
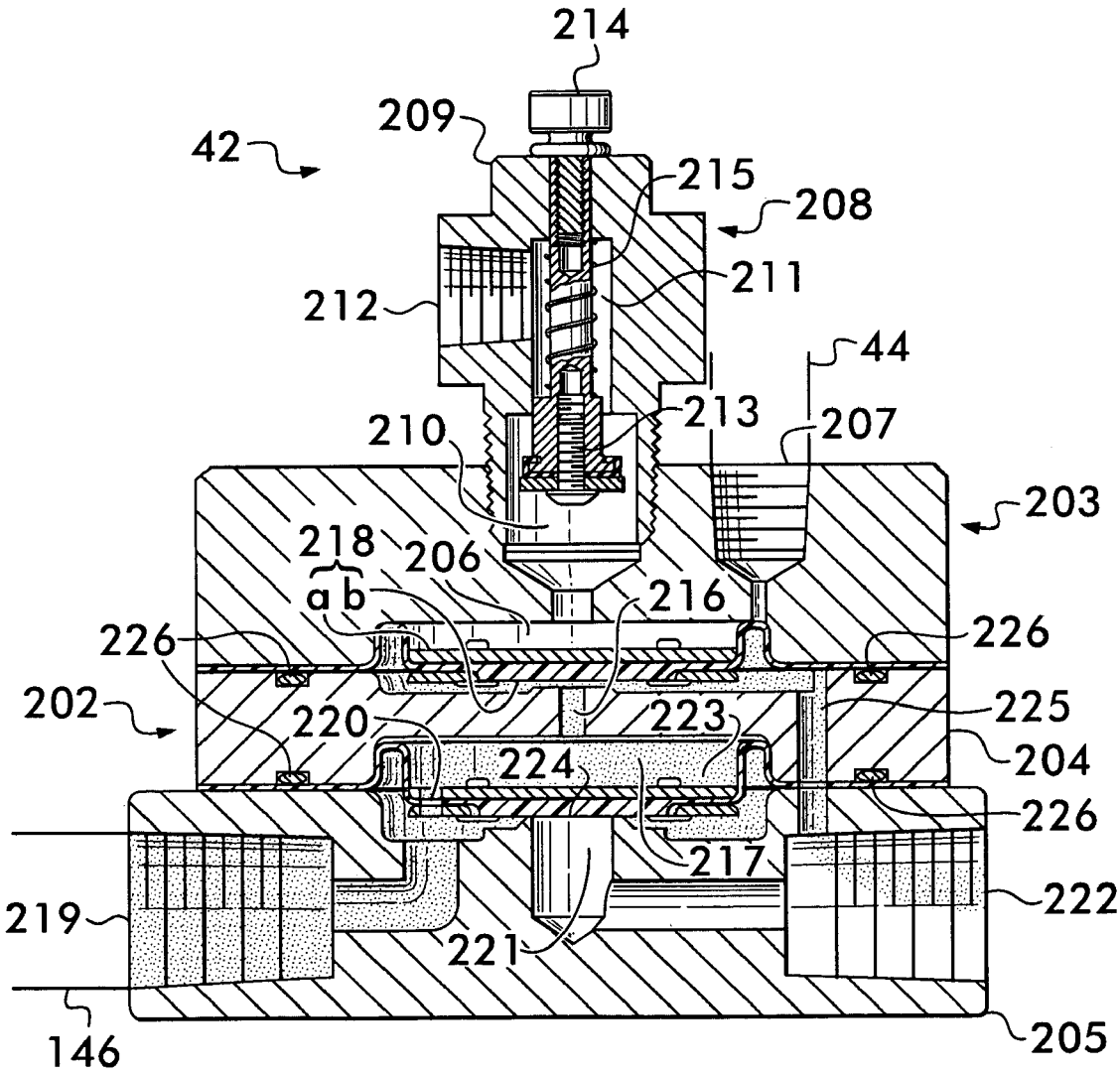

FIG. 7 shows pneumatic actuator 42 during operation when the AC power has failed and the isolation valve 50 is open providing fluid communication between the piping network 12 and the gas inlet orifice 207 through conduit 46 (see also FIG. 1). When gas pressure in the sprinkler system 12 decays due to an open sprinkler that has been actuated or opened by a proximately sensed thermal event, such as a fire, gas pressure in gas compartment 206 of the pneumatic actuator 42 will be reduced at the same decay rate as in the sprinkler system itself. When the gas pressure in gas compartment 206 reaches a set point, such as about 5 psi, the force exerted by tripping device compression spring 215 in tripping device 208 will exceed the force exerted by the air on an air-tight seal formed closure piston 213, causing the tripping device to open. This causes the remaining gas pressure in gas compartment 206 to further decline. Restricted gas inlet orifice 207 in upper chamber 203 causes gas to exit the tripping device gas outlet 212 faster than it can enter gas compartment 206. Water pressure in liquid compartment 217 then causes upper diaphragm 218 to raise, causing water to flow through first liquid outlet orifice 221 to liquid bypass orifice 225 and then to second liquid outlet orifice 222. Orifices 216, 222, and 225 are configured such that water will exhaust from liquid compartment 217 faster then it can flow through second liquid inlet orifice 216.

Figure 8:
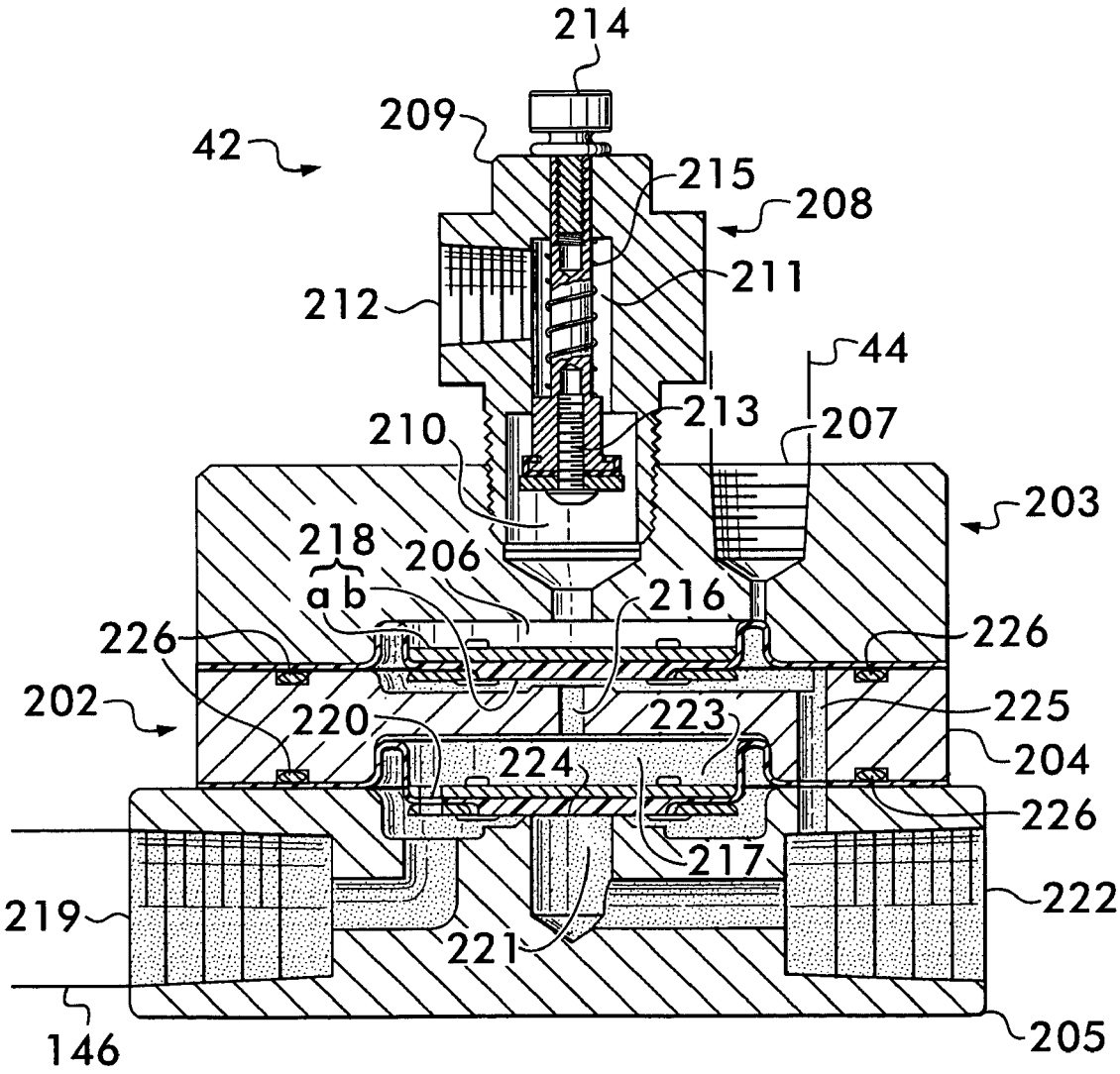

FIG. 8 shows the pneumatic actuator 42 in the final stage of actuation. The flow of water through liquid by-pass outlet orifice 221 causes lower diaphragm 223 to raise, releasing the water tight seal formed by the lower diaphragm 223 against liquid sealing lip 224 and allowing water to flow freely from the control valve 22 through the pneumatic actuator 42 and out second liquid outlet orifice 222 to a drain (not shown), at atmospheric pressure. This water flow depressurizes either the cylinder 140 in control valve 22*a* (see FIG. 3) or the chamber 180 in control valve 22*b* (see FIG. 4) thereby opening the control valve 22 and allowing water to enter the sprinkler system and flow to the individual sprinklers 12.

Electro-Pneumatic Actuator Description and Operation

Figure 10:
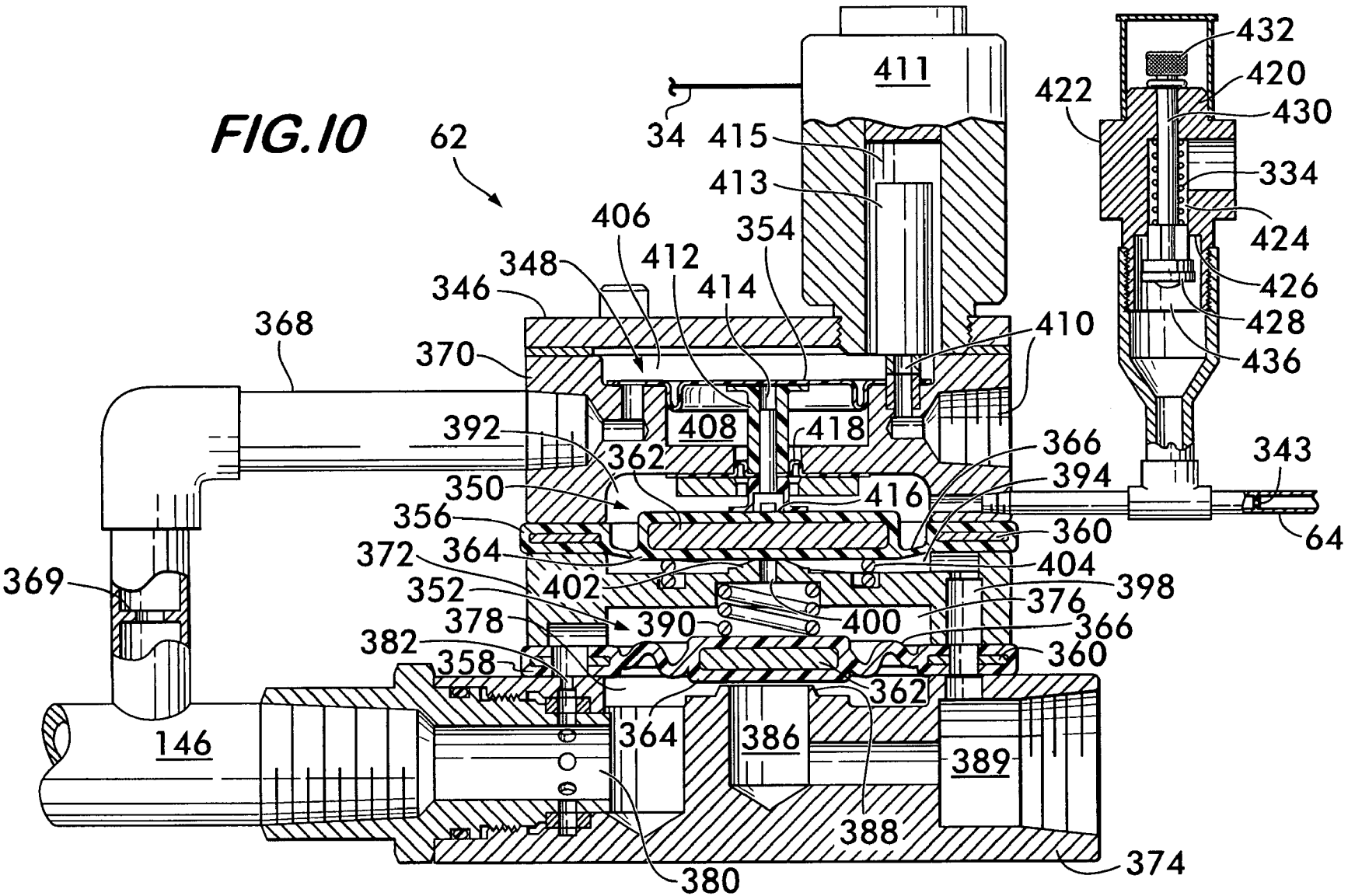
FIG. 10 is a sectional view of an example electro-pneumatic actuator used with the fire suppression system according to the invention.

As shown in cross-section in FIG. 10, the electro-pneumatic actuator 62 has a housing 346 preferably comprised of brass. Housing 346 has three chambers, a top chamber 348, a middle chamber 350 and a bottom chamber 352. Although the chambers are shown positioned one above another and are named top, middle and bottom, it is understood that the orientation of the actuator is irrelevant to its operation and the naming of its parts is for convenience and by way of example only and places no limitations on the structure or configuration of the actuator.

Each chamber is divided into upper and lower chamber portions by respective top, middle and bottom diaphragms 354, 356 and 358. Preferably, diaphragms 356 and 358 comprise a metal ring 360 surrounding a metal plate 362. Both the plate 362 and ring 360 are encapsulated in a flexible sheath 364 and are attached to one another by a membrane portion 366 of the sheath 364 which extends between the plate and the ring. Ring 360 stiffens the perimeter of the diaphragm and provides a means for attaching it to the housing, the ring being sandwiched between various segments 370, 372 and 374 forming the housing. The sheath is preferably EPDM or a similar flexible polymer and provides for a fluid tight seal between the segments. Plate 362 stiffens the diaphragm and the sheath surrounding it ensures a fluid tight seal between the diaphragm and various seats as described below. The membrane portion 366 provides flexibility allowing the diaphragm to deflect in response to fluid pressure on one side or another. Top diaphragm 354 is preferably a simple membrane which performs a sealing function between the upper and lower chamber portions of the top chamber 348. While the diaphragms as described above are preferred, it is understood by those of skill in the art that other types of diaphragms may also be used without adversely affecting the operation of the actuator.

Bottom chamber 352 is divided by bottom diaphragm 358 into an upper chamber portion 376 and a lower chamber portion 378. Both chamber portions 376 and 378 are in fluid communication with either cylinder 140 of control valve 22*a* (see FIG. 3) or chamber 180 of control valve 22*b* (see FIG. 4) through conduit 146 (see FIG. 2). Conduit 146 engages a large diameter duct 380 which connects with the lower chamber portion 378, and a smaller diameter duct 382 which connects to the upper chamber portion 376. Lower chamber portion 378 has a hole 386 surrounded by a seat 388, the hole 386 allowing the lower chamber portion to vent to the ambient through a port 389, the seat 388 being engageable by the bottom diaphragm 358 to seal the hole 386 when the force exerted by the pressure in the upper chamber portion 376 is greater than the force exerted by the pressure in the lower chamber portion 378. Preferably, a biasing means in the form of a spring 390 is positioned within upper chamber portion 376 to bias bottom diaphragm 358 into sealing engagement with seat 388.

Middle chamber 350 is divided into upper and lower chamber portions 392 and 394 respectively by middle diaphragm 356. Upper chamber portion 392 is in fluid communication with piping network 12 through conduit 64 (see also FIG. 2), and lower chamber portion 394 is in fluid communication with the ambient through a duct 398 connecting to port 389. Lower chamber portion 394 is further in fluid communication with upper chamber portion 376 through an aperture 400. A seat 402 surrounds aperture 400, the seat being engageable by middle diaphragm 356 to seal the aperture 400. A biasing means in the form of a spring 404 is positioned within the lower chamber portion 394 to normally bias the diaphragm out of engagement with seat 402.

Top chamber 348 is divided into upper and lower chamber portions 406 and 408 by top diaphragm 354. Upper chamber portion 406 is in fluid communication with control valve 22 through a conduit 368 which branches from conduit 146. Preferably, conduit 368 has a restrictor element 369 which restricts fluid flow to the upper chamber portion 406 but allows the full fluid pressure of pressurized suppressant source 18 to be developed within the upper chamber portion 406.

The upper chamber portion 406 is also in fluid communication with a passageway 410 in fluid communication with the ambient. A valve 411 is engaged with the passageway 410 and has a valve member 413 movable between an open position allowing fluid flow from the upper chamber portion 406 through passageway 410 and to the ambient and a closed position preventing such flow. The valve 411 has a means for normally biasing the valve member into the closed position and an electrically operated actuator for moving the valve member into the open position in response to the electrical signal from the control system 32 carried over communication link 34, which is connected to the valve 411 as shown in FIG. 2. Preferably, valve 411 comprises an electrically actuated solenoid valve and valve member 413 is an armature of the solenoid which is moved into the open position when the solenoid is energized by the electrical signal from the control system 32.

Preferably, the water pressure within upper chamber portion 406 comprises the means for biasing the valve member 413 into the closed position. Solenoid valve 411 comprises a fluid tight valve chamber 415 which is in fluid communication with upper chamber portion 406. Valve member 413 is positioned within the valve chamber 415 and is biased into the closed position, closing off passageway 410, when the upper chamber portion and the valve chamber are pressurized by the pressurized suppressant source 18 communicated through conduits 146 and 368. When the solenoid valve 411 is electrically actuated by the control system 32, the valve member 413 is moved against the pressure within valve chamber 415 away from the passageway 410 allowing the fluid within the valve chamber 415 and the upper chamber portion 406 to flow through the passageway 410 to the ambient.

An elongated plunger 412 extends between lower chamber portion 408 and upper chamber portion 392 of middle chamber 350. One end 414 of the plunger is engageable with top diaphragm 354. The other end 416 of the plunger is engageable with middle diaphragm 356. The plunger is slidably movable within the housing 346, and the lower chamber portion 408 of the top chamber 348 is isolated from the upper chamber portion 392 by a seal 418 surrounding the plunger 412.

Preferably, the upper chamber portion 392 of the middle chamber 350 vents to the ambient through a reset valve 420 positioned in fluid communication with conduit 64, which has a flow restrictor 343 positioned between the reset valve and the piping network 12. Flow restrictor 343 helps isolate the electro-pneumatic actuator 62 from major pressure fluctuations in the piping network and ensures that upper chamber portion 392 vents rapidly through the reset valve 420 when this valve triggers. Reset valve 420 has a valve body 422 through which a conduit 424 extends providing fluid communication between the upper chamber portion 392 and the ambient. A valve seat 426 is positioned at the end of the conduit 424 which is in fluid communication with the conduit 64, and a valve closing member 428 is movably mounted within the conduit and is movable into sealing engagement with the valve seat 426. In the example shown in FIG. 10, valve closing member 428 is mounted on the end of a shaft 430 which is slidably movable within the valve body 422, although other configurations are also feasible.

Shaft 430 extends outwardly from the valve body 422 and has a knob 432 which may be manually grasped to pull valve closing member 428 into engagement with valve seat 426. A biasing means in the form of spring 434 is positioned around shaft 430 to bias the closing member 428 out of engagement with seat 426. Preferably, conduit 424 is sized larger than the valve closing member over a region 436 between seat 426 and the conduit 64 for reasons explained below.

Electro-Pneumatic AND Gate Actuator Operation

As shown in FIG. 2, the electro-pneumatic AND gate actuator 62 is used in the double interlock preaction fire protection system 60 to reset the system (make it ready for actuation) and to actuate the system upon receipt of the appropriate signals. The appropriate signals preferably comprise a pressure drop in the sprinkler piping network 12 caused by one or more sprinklers 20 opening in response to the heat of a fire and an electrical signal from the control system 32 in response to signals from one or more fire sensors 28.

System Reset Function

The sprinkler system 60 is made ready for action by resetting both the electrical and the pneumatic functions of the electro-pneumatic actuator 62. Water from the pressurized suppressant supply 18 acting through conduits 146 and 368 flows to the upper chamber portion 406 of top chamber 348 and into the valve chamber 415 of solenoid valve 411. Assuming the solenoid valve 411 is energized by a signal from the control system 32, valve member 413 is held in the open position and water flows from the upper chamber portion 406 through passageway 410 to the ambient. The electrical function of the sprinkler system 60 is then reset by removing the signal from the control system 32 to the solenoid valve 411. This releases valve member 413 which moves in response to the water flow through the valve chamber 415 into the closed position preventing further flow of water through passageway 410 to the ambient. Water pressure increases within the valve chamber 415 as well as within upper chamber 406, the pressure securely seating the valve member 413 closed and deflecting the top diaphragm 354 toward the middle chamber 350. The top diaphragm 354 engages end 414 of plunger 412, forcing the opposite plunger end 416 into engagement with the middle diaphragm 356 and causing it to deflect into lower chamber portion 394 against biasing spring 404. Middle diaphragm 356 sealingly engages seat 402 to close the aperture 3100 between the lower chamber portion 394 and the adjacent upper chamber portion 376. Gas in lower chamber portion 394 is vented to ambient through duct 398 and port 389.

Compressed gas (normally air) is supplied to the electro-pneumatic actuator 62 from the compressed gas supply 24 through conduit 64. Assuming reset valve 420 is open, the air flows through it to the ambient. To reset the pneumatic function of the electro-pneumatic actuator 62, an operator pulls upwardly on the reset knob 432 on the reset valve 420, moving the valve closing member 428 against biasing spring 434 and seating the valve closing members against valve seat 426. When the valve closing member 428 is in the unseated (open) position as shown in FIG. 10, compressed air normally flows around it due to the enlarged regions 436 of conduit 424. Enlarged conduit region 436 prevents an air pressure surge in the system from unintentionally resetting the system during a fire (and thereby cutting off the water to the sprinklers) by inadvertently seating the valve closing member 428. Because of the enlarged conduit region 436, the valve closing member in valve 420 must be held in the seated position until sufficient pressure is achieved within upper chamber 392 and conduit 64 to exert a force on the valve closing member 428 which exceeds the biasing force of spring 434. The spring 434 and valve closing member 428 are designed such that a pressure above about 6.5 psi in upper chamber 392 and conduit 64 is sufficient to keep the valve closing member seated. The reset valve is, thus, used to establish a relatively low pressure trip point for the system as described in more detail below.

With the reset valve 420 closed, air pressure increases in the upper chamber portion 392. This pressure will cause middle diaphragm 356 to deflect into the lower chamber portion 408 forcing it to engage seat 402 and close off aperture 400 independently of the action of the top diaphragm 354 acting through plunger 412 described above. Together the top and middle diaphragms 354 and 356 provide the AND gate logic function of the actuator 62 in that both diaphragms must be allowed to independently deflect to allow the bottom diaphragm 358 to unseat and open aperture 400 to actuate the control valve 22 supplying water to the sprinkler heads as described further below. Either diaphragm alone, however, can exert sufficient force to keep the bottom diaphragm 358 seated and prevent actuation of the system 60.

Bottom diaphragm 358 is normally biased into engagement with seat 388 by spring 390, thus, sealing hole 386 which would otherwise vent the lower chamber portion 378 to the ambient through port 389. As shown in FIGS. 2, 3, 4 and 10, water pressure through conduit 146 pressurizes either the cylinder 140 in valve 22*a* or the chamber 180 in valve 22*b*, keeping the control valve 22 closed and cutting water off from the sprinkler piping network 12. When valve 22*a* is used, the cylinder 140 is in fluid communication with lower chamber portion 378 of actuator 62 through conduit 146 and with upper chamber portion 376 through the small diameter duct 382 fed from conduit 146. Water pressure within the cylinder 140, which keeps clapper 134 closed also forces bottom diaphragm 358 against seat 388 to close hole 386. The water pressure in upper chamber portion 376 exerts greater force on the bottom diaphragm 358 than the same pressure in lower chamber portion 378 since the water pressure in the lower chamber portion 378 does not act over the entire area of the diaphragm as it does in the upper chamber portion 376. This is because the central portion of diaphragm 358 is exposed to atmospheric pressure through hole 386 when the diaphragm 358 is seated against seat 388, and the water pressure within chamber 378 cannot act against this central portion isolated by seat 388. The system is now set and ready to supply water to sprinklers 20 as called for to suppress a fire. (When control valve 22*b* is used it is the chamber 180 which is pressurized analogous to cylinder 140 in valve 22*a*, the full description not being repeated here.)

System Actuation

Heat from a fire will cause one or more sprinklers 20 on the piping network 12 in the immediate vicinity of the fire to open. This allows compressed gas within the piping network to vent to the ambient, causing a pressure drop in the piping network. As shown in FIG. 10, the upper chamber portion 392 of the middle chamber 350 is in fluid communication with the piping network 12 through conduit 64. A pressure drop in the piping network 12 will thus be communicated to the chamber portion 392 within the electro-pneumatic actuator 62.

Contemporaneously with the opening of sprinklers 20, the fire sensors 28 in the immediate vicinity of the fire will sense the fire and signal the control system 32 through communications link 30. In response, control system 32 sends a signal via communications link 34 to the solenoid valve 411, energizing the solenoid and moving the valve member 413 against the biasing pressure within valve chamber 415 to open the passageway 410 and allow the water within upper chamber portion 406 to flow through the passageway to the ambient, thus, relieving the pressure deflecting the top diaphragm 354 toward the middle chamber 350. This also relieves the force on plunger 412 and allows the middle diaphragm to deflect away from seat 402, thus, opening aperture 400, provided that the air pressure within upper chamber portion 392 is also reduced.

The reduction in air pressure within upper chamber 392 occurs due to the opening of sprinklers 20 in response to the fire as described above. When the air pressure in upper chamber portion 392 drops to a predetermined value (preferably about 6.5 psi), the reset valve 420 opens (valve closing element 428 unseats from seat 426 and is biased into enlarged conduit region 436) venting the upper chamber portion 392 to the ambient and causing a rapid pressure drop in the upper chamber portion. As the pressure in upper chamber portion 392 drops, it falls below a second predetermined value which allows biasing spring 404 to deflect both the top and middle diaphragms 354 and 356 upwardly, unseating middle diaphragm 356 from seat 402 and opening aperture 400. This allows water under pressure in upper chamber portion 376 to flow through aperture 400, into lower chamber portion 394 and out to the ambient through duct 398 and port 389. With the water pressure in upper chamber portion 376 thus relieved, the bottom diaphragm 358 is deflected by water pressure within lower chamber portion 378, the bottom diaphragm is unseated from seat 388, allowing water from conduit 146 to vent to the ambient. Deflection of the bottom diaphragm 358 away from seat 388 is ensured by making the diameter 380 of conduit 146 feeding lower chamber portion 378 relatively large as compared with the diameter of duct 382 which feeds the upper chamber portion 376. Despite being at the same pressure, water from conduit 332 cannot flow fast enough through small diameter duct 382 to pressurize upper chamber portion 376 and deflect the bottom diaphragm 358 into engagement with seat 388.

When control valve 22*a* is used, conduit 146 is in fluid communication with cylinder 140. Thus, when the conduit 146 is vented to ambient by the action of bottom diaphragm 358, cylinder 140 is depressurized. This allows spring 142 to move the piston 138 and release latch 136, allowing clapper 134 to open under the pressure of pressurized suppressant source 18 and supply water to the piping network 12 where the water is released from the open sprinklers 20 onto the fire. When control valve 22*b* is used, conduit 146 is in fluid communication with chamber 180. Thus, when the conduit 146 is vented to ambient by the action of bottom diaphragm 358, chamber 180 is depressurized. This allows diaphragm 178 to deform and allow latch 168 to pivot, allowing clapper 162 to open under the pressure of pressurized suppressant source 18 and supply water to the piping network 12 where the water is released from the open sprinklers 20 onto the fire.

Based upon the foregoing description of the electro-pneumatic actuator 62 and its operation, it is possible to view the actuator as comprised of a plurality of pressure actuated valves. Bottom chamber 352 and its associated bottom diaphragm 358 comprise an example of a first pressure actuated valve controlling the flow of the pressurized fluid through the actuator. This first valve has a first valve closing member (diaphragm 358) with opposite sides both in fluid communication with the pressurized fluid. The first valve is normally closed and prevents the fluid flow which depressurizes the piston 326. The first valve closing member opens to permit the depressurizing flow when the fluid pressure on one side of the first valve closing member exceeds the fluid pressure on the opposite side of the first valve closing member.

The middle chamber 350 and its middle diaphragm 356 comprise an example of a second pressure actuated valve controlling the fluid pressure on the opposite side of the first valve closing member. The second valve has a second valve closing member (diaphragm 356) which is movable from a closed position, which maintains fluid pressure on the opposite side of the first valve closing member, to an open position, which releases fluid pressure from the opposite side of the first valve closing member. The second valve closing member has a side in fluid communication with a first source of compressed fluid and is movable from the closed to the open position in response to a decrease in pressure of the first source of compressed fluid.

The solenoid valve 411 comprises an example of a third pressure actuated valve. The third pressure actuated valve has a third valve closing member 413 with a mechanical link to the second valve closing member through top diaphragm 354 and plunger 412. The third valve closing member has a side in fluid communication with a source of compressed fluid and is movable from a first position which maintains a force through the mechanical link onto the second valve closing member (thereby maintaining the second valve closing member in the closed position) to a second position removing the force from the second valve closing member. The third valve closing member is electrically actuated and moves to the second position in response to an electrical signal from the control system 32. However, both the third and second valve closing members move into their respective open positions only upon a concurrent pressure decrease in the piping network and an electrical signal to the electro-pneumatic actuator, as occurs when the piping network 12 is vented when one or more sprinklers open and one or more of the sensors 28 send a signal to the control system 32 in the event of a fire. Motion of both the second and third valve closing members allows the first valve closing member to move into its open position and permit flow of the pressurized fluid through the actuator, thereby depressurizing piston 326 and triggering the sprinkler system. A similar analysis may be made for the pneumatic actuator 42, which can also be regarded as a plurality of pressure actuated valves.

FIG. 11 provides a flow chart which illustrates the logic of the operation of the fire suppression sprinkler system according to the invention. Starting at 11, the system is on-line and ready to detect a loss of AC power. If no AC power loss is detected the system operates normally, as shown at 13 to detect a fire condition. As long as no fire condition is detected the logic remains in the loop between 11 and 13, alternately ready to detect a loss of AC power or a fire condition. For the single interlock system 10 a fire condition is detected when a sensor 28 sends a signal to the control system 32. For the double interlock system 60 a fire condition is detected when a sensor 28 sends a signal to the control system 32 and the electro-pneumatic actuator 62 detects a change in gas pressure within piping network 12. Once a fire condition is detected the control system sends signals which open the control valve 22 and release fire suppressant to the piping network, as shown at 15. The fire suppressant is then delivered to the fire though open sprinklers 20 in the vicinity of the fire as indicated at 17.

If a loss of AC power is detected at 11 then the control system 32 opens the isolation valve 50, putting the pneumatic actuator 42 in fluid communication with the piping network 12, as shown at 19. As long as there is no change in the gas pressure of the piping network (21) the system considers whether AC power has been restored (23). If AC power has been restored the isolation valve 50 is closed (25) and the system resumes the loop between detecting a loss of AC power (11) and detecting a fire condition (13). If AC power has not been restored (23), the system stays in the loop between 21 and 23, alternating between detecting restoration of AC power and detecting a gas pressure change in the piping network 12. If a pressure change is detected (21) the pneumatic actuator 42 opens the control valve to release fire suppressant to the piping network (27). This allows open sprinklers to deliver fire suppressant to the fire (17).

The fire suppressant system according to the invention is advantageous because, through the use of an isolation valve which does not draw any power except to change state from open to closed and vice versa, it provides for fire protection in the absence of both AC power and battery back-up. The protection is automatic in that the system senses the condition of the electrical power and shifts control from the single (electrical) interlock or the double (electro-pneumatic) interlock to a purely pneumatic single interlock system which requires no electrical power to function and provide fire protection.

What is claimed is:

1. A fire suppression sprinkler system for conducting a fire suppressant from a pressurized source of said suppressant to a fire, said system being powered by an electrical power supply and an electrical battery and comprising:

a piping network in fluid communication with said pressurized source of fire suppressant;

at least one sprinkler in fluid communication with said piping network, said sprinkler being normally closed and having means for opening in response to a fire;

a control valve positioned in said piping network between said pressurized source and said sprinkler for controlling flow of said fire suppressant from said pressurized source to said sprinkler, said control valve being normally maintained in a closed configuration, said control valve being openable to permit said fire suppressant to flow to said sprinkler;

a source of compressed gas in fluid communication with said piping network between said control valve and said sprinkler for pressurizing said piping network with said gas;

an electrical actuator associated with said control valve for opening said control valve in response to an electrical signal, said electrical actuator being powered at least by said power supply;

a pneumatic actuator in fluid communication with said piping network, said pneumatic actuator being associated with said control valve for opening said control valve in response to a pressure change within said piping network;

an isolation valve in fluid communication with and positioned between said pneumatic actuator and said piping network, said isolation valve controlling gas flow from said piping network to said pneumatic actuator, said isolation valve being powered by said power supply or said battery and settable in either an open configuration allowing fluid flow between said piping network and said pneumatic actuator, or a closed configuration preventing fluid flow between said piping network and said pneumatic actuator, said isolation valve drawing no electrical power when set in either of said open or closed configurations;

at least one fire sensor co-located with said sprinkler, said fire sensor being powered at least by said power supply;

a control system in communication with said electrical actuator, said isolation valve, and said fire sensor, said control system being powered by said power supply and said battery, said control system having a circuit to detect loss of power from said power supply and being programmed to set said isolation valve in said open configuration in response thereto.

2. The system according to claim 1, wherein said control system further comprises a circuit to detect a resumption of power from said power supply, said control system being programmed to set said isolation valve in said closed configuration in response thereto.

3. The system according to claim 1, wherein said isolation valve comprises an electrically actuated valve.

4. The system according to claim 3, wherein said isolation valve comprises a latching solenoid valve.

5. The system according to claim 3, wherein said isolation valve is selected from the group consisting of ball valves, butterfly valves, gate valves and globe valves.

6. The system according to claim 1, wherein said control valve comprises a chamber in fluid communication with said pressurized source of fire suppressant, said control valve being maintained in said closed configuration when said chamber is pressurized, said control valve opening to permit said fire suppressant to flow to said sprinkler when said chamber is depressurized.

7. The system according to claim 6, wherein said electrical actuator comprises a solenoid valve in fluid communication with said chamber, said solenoid valve being normally closed and openable in response to an electrical signal from said control system, opening of said solenoid valve depressurizing said chamber and thereby allowing said control valve to open.

8. The system according to claim 6, wherein said pneumatic actuator comprises:

a first valve in fluid communication with said chamber, said first valve being normally closed, opening of said first valve depressurizing said chamber and thereby allowing said control valve to open;

a second valve in fluid communication with said first valve and said piping network, said second valve being normally closed and openable in response to a change in gas pressure within said piping network, opening of said second valve causing said first valve to open.

9. The system according to claim 1, further comprising a second pneumatic actuator in fluid communication with said piping network, said second pneumatic actuator being associated with said control valve for opening said control valve in response to a pressure change within said piping network, said second pneumatic actuator cooperating with said electrical actuator to open said control valve, said control valve being openable in response to said electrical signal to said electrical actuator and said pressure change within said piping network.

10. A fire suppression sprinkler system for conducting a fire suppressant from a pressurized source of said suppressant to a fire, said system being powered by an electrical power supply and comprising:

a piping network in fluid communication with said pressurized source of fire suppressant;

at least one sprinkler in fluid communication with said piping network, said sprinkler being normally closed and having means for opening in response to a fire;

a control valve positioned in said piping network between said pressurized source and said sprinkler for controlling flow of said fire suppressant from said pressurized source to said sprinkler, said control valve being normally maintained in a closed position and openable to permit said fire suppressant to flow to said sprinkler;

a first actuator in communication with said control valve, said first actuator being electrically powered by said power supply and controlling the opening of said control valve in response to an electric signal;

a source of compressed gas in fluid communication with said piping network between said control valve and said sprinkler for pressurizing said piping network with said gas;

a second actuator in communication with said control valve and in fluid communication with said piping network, said second actuator having a pressure sensor for detecting a change in pressure within said piping network and opening said control valve in response to said pressure change;

a latching solenoid valve in fluid communication with and positioned between said second actuator and said piping network, said latching solenoid valve controlling gas flow from said piping network to said second actuator, said latching solenoid valve being powered by said power supply and settable in either an open configuration allowing fluid flow between said piping network and said second actuator, or a closed configuration preventing fluid flow between said piping network and second actuator;

at least one fire sensor co-located with said sprinkler, said fire sensor being powered by said power supply;

a control system in communication with said first actuator, said latching solenoid valve, and said fire sensor, said control system being powered by said power supply and an electrical battery, said control system having a circuit to detect loss of power from said power supply and being programmed to set said latching solenoid valve in said open configuration in response thereto.

11. The system according to claim 10, wherein said control system further comprises a circuit to detect resumption of power from said power supply, said control system being programmed to set said latching solenoid in said closed configuration in response thereto.

12. A fire suppression sprinkler system for conducting a fire suppressant from a pressurized source of said suppressant to a fire, said system being powered by an electrical power supply and comprising:

a piping network in fluid communication with said pressurized source of fire suppressant;

at least one sprinkler in fluid communication with said piping network, said sprinkler being normally closed and having means for opening in response to a fire;

a control valve positioned in said piping network between said pressurized source and said sprinkler for controlling flow of said fire suppressant from said pressurized source to said sprinkler, said control valve comprising a chamber in fluid communication with said pressurized source, said control valve being maintained in a closed position when said chamber is pressurized, said control valve opening to permit said fire suppressant to flow to said sprinkler when said chamber is depressurized;

a first valve in fluid communication with said chamber, said first valve being electrically powered by said power supply, said first valve being normally closed and openable in response to an electrical signal, opening of said first valve depressurizing said chamber and thereby allowing said control valve to open;

a source of compressed gas in fluid communication with said piping network between said control valve and said sprinkler for pressurizing said piping network with said gas;

a second valve in fluid communication with said chamber, said second valve being normally closed, opening of said second valve depressurizing said chamber and thereby allowing said control valve to open;

a third valve in fluid communication with said second valve and said piping network, said third valve being normally closed and openable in response to a change in gas pressure within said piping network, opening of said third valve causing said second valve to open;

a latching solenoid valve in fluid communication with and positioned between said third valve and said piping network, said latching solenoid valve controlling gas flow from said piping network to said third valve, said latching solenoid valve being powered by said power supply and settable in either an open configuration allowing fluid flow between said piping network and said third valve, or a closed configuration preventing fluid flow between said piping network and said third valve;

at least one fire sensor co-located with said sprinkler, said fire sensor being powered by said power supply;

a control system in communication with said first valve, said latching solenoid valve, and said fire sensor, said control system being powered by said power supply and an electrical battery, said control system having a circuit to detect loss of power from said power supply and being programmed to set said latching solenoid valve in said open configuration in response thereto.

13. The system according to claim 12, said control system further comprising a circuit to detect resumption of power from said power supply, said control system being programmed to set said latching solenoid valve in said closed configuration in response thereto.

14. A fire suppression sprinkler system for conducting a fire suppressant from a pressurized source of said suppressant to a fire, said system being powered by an electrical power supply and an electrical battery and comprising:

a piping network in fluid communication with said pressurized source;

at least one sprinkler in fluid communication with said piping network, said sprinkler being normally closed and having means for opening in response to a fire;

a control valve positioned in said piping network between said pressurized source and said sprinkler for controlling flow of said fire suppressant from said pressurized source to said sprinkler, said control valve being normally maintained in a closed position, said control valve being openable to permit said fire suppressant to flow to said sprinkler;

a source of compressed gas in fluid communication with said piping network between said control valve and said sprinkler for pressurizing said piping network with said gas;

an electro-pneumatic actuator associated with said control valve for opening said control valve in response to an electrical signal and a pneumatic signal, said electro-pneumatic actuator being powered at least by said power supply;

a pneumatic actuator in fluid communication with said piping network, said pneumatic actuator being associated with said control valve for opening said control valve in response to a pressure change within said piping network;

an isolation valve in fluid communication with and positioned between said pneumatic actuator and said piping network, said isolation valve controlling gas flow from said piping network to said pneumatic actuator, said isolation valve being powered by said power supply or said battery and settable in either an open configuration allowing fluid flow between said piping network and said pneumatic actuator, or a closed configuration preventing fluid flow between said piping network and said pneumatic actuator, said isolation valve drawing no electrical power when set in either of said open or closed configurations;

at least one fire sensor co-located with said sprinkler, said fire sensor being powered at least by said power supply;

a control system in communication with said electro-pneumatic actuator, said isolation valve, and said fire sensor, said control system being powered by said power supply and said battery, said control system having a circuit to detect loss of power from said power supply and being programmed to set said isolation valve in said open configuration in response thereto.

15. The system according to claim 14, wherein said control system further comprises a circuit to detect a resumption of power from said power supply, said control system being programmed to set said isolation valve in said closed configuration in response thereto.

16. The system according to claim 14, wherein said isolation valve comprises a latching solenoid valve.

17. The system according to claim 14, wherein said control valve comprises a chamber in fluid communication with said pressurized source of fire suppressant, said control valve being maintained in a closed position when said chamber is pressurized, said control valve opening to permit said fire suppressant to flow to said sprinkler when said chamber is depressurized.

18. The system according to claim 17, wherein said electro-pneumatic actuator comprises:

a first valve in fluid communication with said chamber, said first valve being normally closed, opening of said first valve depressurizing said chamber and thereby allowing said control valve to open;

a second valve in fluid communication with said first valve and said piping network, said second valve being normally closed and openable in response to a pressure change within said piping network;

a third valve in fluid communication with said chamber and mechanically linked to said second valve, said third valve being normally closed and openable in response to an electrical signal from said control system, opening of said third valve in conjunction with a pressure change in said piping network allowing aid second valve to open, thereby allowing said first valve to open, and thereby allowing said control valve to open.

19. The system according to claim 17, wherein said pneumatic actuator comprises:

a first valve in fluid communication with said chamber, said first valve being normally closed, opening of said first valve depressurizing said chamber and thereby allowing said control valve to open;

a second valve in fluid communication with said first valve and said piping network, said second valve being normally closed and openable in response to a change in gas pressure within said piping network, opening of said second valve causing said first valve to open.

* * * * *